US007002541B2

(12) United States Patent
Yanagi et al.

(10) Patent No.: US 7,002,541 B2
(45) Date of Patent: Feb. 21, 2006

(54) ACTIVE MATRIX TYPE DISPLAY AND A DRIVING METHOD THEREOF

(75) Inventors: Toshihiro Yanagi, Taki-gun (JP); Kouji Kumada, Tenri (JP); Takashige Ohta, Yamatokoriyama (JP); Katsuya Mizukata, Shijonawate (JP)

(73) Assignee: Sharp Kabushiki Kaisha, Osaka (JP)

( * ) Notice: Subject to any disclaimer, the term of this patent is extended or adjusted under 35 U.S.C. 154(b) by 382 days.

(21) Appl. No.: 09/974,297

(22) Filed: Oct. 4, 2001

(65) Prior Publication Data

US 2002/0041281 A1 Apr. 11, 2002

(30) Foreign Application Priority Data

Oct. 6, 2000 (JP) ..... 2000-308394

(51) Int. Cl.
*G09G 3/36* (2006.01)

(52) U.S. Cl. ..... 345/92

(58) Field of Classification Search ..... 345/87, 345/90, 92, 94, 98, 99, 100, 204, 205, 211; 349/33, 34, 37, 38, 39, 46–47
See application file for complete search history.

(56) References Cited

U.S. PATENT DOCUMENTS 5,627,560 A * 5/1997 Verhulst ..... 345/97
5,657,039 A * 8/1997 Mizukata et al. ..... 345/95
5,751,267 A * 5/1998 Sato et al. ..... 345/96
5,892,494 A 4/1999 Kimura et al.
5,945,972 A 8/1999 Okumura et al.
6,084,562 A * 7/2000 Onda ..... 345/94
6,166,714 A * 12/2000 Kishimoto ..... 345/96

FOREIGN PATENT DOCUMENTS

| | | |
|---|---|---|
| JP | 54-005399 | 1/1979 |
| JP | 05-196914 | 8/1993 |
| JP | 08-184809 | 7/1996 |
| JP | 09-033892 | 2/1997 |
| JP | 11-15452 | 1/1999 |
| JP | 11-149277 | 6/1999 |

OTHER PUBLICATIONS

U.S. Appl. No. 09/856,926, filed May 29, 2001, Yanagi et al.

* cited by examiner

*Primary Examiner*—Chanh Nguyen
(74) *Attorney, Agent, or Firm*—David G. Conlin; Steven M. Jensen; Edwards Angell Palmer & Dodge LLP

(57) ABSTRACT

In an active matrix type display device, a signal voltage is applied from a signal line driving circuit via an active element such as a TFT to display electrodes on a matrix substrate, and a common voltage is applied to a counter electrode on a facing substrate so that the common voltage is shared by respective display cells. A level of the common voltage is switched in every refresh period of a different length. Thus, it is possible to appropriately set a value of the common voltage which is a reference for specifying an effective voltage of positive polarity and an effective voltage of negative polarity according to the refresh periods. As a result, even when the refresh periods of a different length exist in a mixed manner, it is possible to equalize the effective voltage of positive polarity and the effective voltage of negative polarity so as to suppress an occurrence of a flicker.

26 Claims, 22 Drawing Sheets

ACTIVE MATRIX TYPE DISPLAY AND A DRIVING METHOD THEREOF

FIELD OF THE INVENTION

The present invention relates to an active matrix type display device which can improve display quality by reducing the flicker, and a driving method of the active matrix type display device.

BACKGROUND OF THE INVENTION

A liquid crystal display device which employs an active matrix driving method is known as a conventional image display device. The liquid crystal display device, as shown in FIG. 19, includes a liquid crystal panel 1, a scanning line driving circuit 2, a signal line driving circuit 3, and a buffer circuit 4.

The liquid crystal panel 1 includes a matrix substrate 11, a facing substrate 12 provided so that it faces the matrix substrate 11 in parallel, and liquid crystal (not shown) filled between the both substrates 11 and 12. There are a plurality of scanning lines G(0) to G(3) and a plurality of signal lines S(0) to S(3) which cross each other and display cells 13 provided in a matrix manner on the matrix substrate 11. Counter electrode 16 shown in FIG. 20 is provided on the facing substrate 12 so that the counter electrode 16 solely corresponds to the display cells 13. Note that, although a case where the counter electrode 16 is provided on the facing substrate 12 is shown here, there is also an IPS (In Plane Switching) structure in which the counter electrode 16 is provided on the matrix substrate 11.

The display cell 13, as shown in FIG. 20, includes a thin film transistor (hereinbelow referred to as TFT) 14 which is a switching element, and a liquid crystal capacitance CLC. A source of the TFT 14 is connected to the signal line S(i), and a gate of the TFT 14 is connected to the scanning line G(j). Signal voltages V sp and V sn which are outputted from the signal line driving circuit 3 to the signal line S(i) are applied as a drain voltage Vd (i,j) via the source and a drain of the TFT 14 to a display electrode 15 which is an electrode of the liquid crystal capacitance CLC. Further, a common voltage V com which is outputted from the buffer circuit 4 shown in FIG. 19 is applied to the counter electrode 16 which is another electrode of the liquid crystal capacitance CLC.

In this way, when potential deference between the drain voltage V d (i,j) and the common voltage V com is applied to the liquid crystal capacitance CLC, the transmittance or the reflection ratio of the liquid crystal 17 between the both electrodes 15 and 16 are changed, so that an image which corresponds to an inputted image data is displayed on the display cells 13. Further, a charge accumulated in the liquid crystal capacitance CLC is stored in for a given period, so that an image is kept displayed in the respective display cells 13, corresponding to the holding of the charge, even when the TFT 14 is OFF.

A method for displaying an image by scanning (applying) successively like the foregoing driving method is called a refresh method. Further, a period in which the signal voltages V sp and V sn are applied to the display cell 13, and further, the signal voltages V sp and V sn are stored by the liquid crystal capacitance CLC is called a refresh period.

In this liquid crystal display device, as shown in FIG. 21, when a gate pulse of potential differences (V gh to V gl) is outputted from the scanning line driving circuit 2 to the scanning line G(j) in the first refresh period T v1, the TFT 14 becomes ON, so that the signal voltage V sp of positive polarity which is being outputted from the signal line driving circuit 3 to the signal line S(i) in this while is applied to the display cell 13. Thereafter, the signal voltage V sp is stored by the liquid crystal capacitance CLC. In the next refresh period T v1, the signal voltage V sn of negative polarity which is being outputted from the signal line driving circuit 3 to the signal line S(i) is applied to the display cell 13 and stored in the same manner, while the TFT 14 is ON. In the liquid crystal display device, in order to prevent deterioration of the liquid crystal due to the application of the d.c. voltage, the signal voltages V sp and V sn of a different polarity are applied repeatedly, so that the liquid crystal is a.c.-driven, for example, in every dot.

Further, a luminous property is specified by an effective value (effective voltage V rms(P1) and V rms(N1)) of a differential voltage between the signal voltages V sp and V sn which is stored by the liquid crystal capacitance CLC. Thus, when the effective voltage V rms(P1) is not equal to the effective voltage V rms(N1), change of the luminance occurs in every refresh period, so that flicker occurs in the screen. As a result, the display quality degrades so much, and a residual DC which can bring about the deterioration of the liquid crystal is applied to the liquid crystal.

For example, in order to clear the foregoing defect, as shown in FIG. 19, an offset adjusting circuit 31 made of a variable resistance is provided in a conventional liquid crystal display device. In the offset adjusting circuit 31, a power supply voltage V ref is adjusted by the offset adjusting circuit 31 and the common voltage V com is changed so that the effective voltage V rms(P1) is equal to the effective voltage V rms(N1). In this way, the common voltage V com is adjusted, so that it is possible to suppress the flicker. The prior art, for example, is disclosed in Japanese Unexamined Patent Publication No. 15452/1999 (Tokukaihei 11-15452) (publication date: Jan. 22, 1999).

Incidentally, as shown in FIG. 21, there is a liquid crystal display device whose display is switched in a high-speed refresh display mode (hereinbelow referred to as display mode A) for displaying in a short refresh period T v1 and in a low-speed refresh display mode (hereinbelow referred to as B mode) for displaying in a long refresh period T v2. In this case, even when the signal voltages V sp and V sn are applied to the display cell 13 and are stored, in the display mode B whose refresh period is long, the effective voltage V rms(P2) is not equal to the effective voltage V rms(N2) in the refresh periods T v2 and T v2. This is caused by the following operating characteristic of the TFT 14.

First, as shown in FIG. 21, when the signal voltage V sp is applied and is stored, an OFF voltage V off(P) of the TFT 14 is a difference between a high stored potential and the potential V gl. When the signal voltage V sn is applied and is stored, an OFF voltage V off(N) of the TFT 14 is a difference between a low stored potential and the potential V gl.

Further, as shown in V gd-Id characteristic of FIG. 22 (V gd shows a voltage of the gate/drain line, and Id shows a drain current), the TFT 14 is not an ideal switch in that a leak current flows when it is OFF, and a leak current corresponding to the OFF voltage V off(N) and a leak current corresponding to the OFF voltage V off(P) are different in power.

Thus, the case where the signal voltage V sp is applied and stored is different from the case where the signal voltage V sn is applied and stored, in terms of amount of leak discharge in storing the voltage. As a result, as shown in FIG. 21, the effective voltage V rms(P2) and the effective voltage V rms(N2) which are based on the common voltage V com decline in different inclination, so that imbalance occurs. As the influence of this, the longer the refresh period becomes, the more imbalance occurs, so that change of the luminance occurs every time the refresh period changes. As a result, flicker occurs, and the quality of a displayed image degrades.

Note that, the refresh period is changed when a display mode is changed by a computer display, or when a TV display mode (NTSC and PAL) is switched. In addition to this, the refresh period is changed in low-frequency driving and cessation driving both of which are performed so that power can be saved.

Further, a leak current which occurs in the liquid crystal itself and other cause (leak current of the liquid crystal capacitance itself) bring about the imbalance of the effective voltages V rms(P2) and V rms(N2). Therefore, in order to suppress the occurrence of the flicker due to these causes, it is required to clear the imbalance of the effective voltage, regardless of the length of the refresh period.

SUMMARY OF THE INVENTION

The object of the present invention is to provide an active matrix type display device which can clear an imbalance of an effective voltage even though refresh periods of a different length exist in a mixed manner, and to provide a driving method of the active matrix type display device.

In the active matrix type display device and its driving method of the present invention, in order to achieve the foregoing object, the active matrix type display device includes plural display electrodes provided in a matrix manner; a counter electrode which is provided so that it faces the display electrode and a common voltage is applied to the counter electrode; an active element for applying a signal voltage to the display electrode when a scanning line is selected; and a storage capacitor for storing a driving voltage which is determined by the signal voltage applied to the display electrode and a common voltage. The active matrix type display device enables level varying means to change a level of the common voltage or the signal voltage according to the length of the applying-storing period in which the signal voltage is applied and the driving voltage is stored.

For example, in a liquid crystal display device, as described above, an optical response of the liquid crystal is specified by an effective value of the driving voltage which is stored by the storage capacitor, so that the effective value of the driving voltage varies according to the applying-storing period (refresh period). Thus, the level of the common voltage or the signal voltage is varied by the level varying means of the display device, so that the effective value of the driving voltage which is determined by the signal voltage and the common voltage is changed. In order to vary the level of the common voltage or the signal voltage, it is preferable that, for example, plural d.c. voltages as the common voltage or the signal voltage is used, and the d.c. voltages are changed by the voltage switching means in every applying-storing period of a different length. Therefore, it is possible to clear the imbalance of the effective value of the driving voltage by varying the level of the common voltage appropriately.

For a fuller understanding of the nature and advantages of the invention, reference should be made to the ensuing detailed description taken in conjunction with the accompanying drawings.

DESCRIPTION OF THE EMBODIMENT

[First Embodiment]

The first embodiment of the present invention is described as follows based on FIG. 1 to FIG. 3, and FIG. 20.

Figure 1:
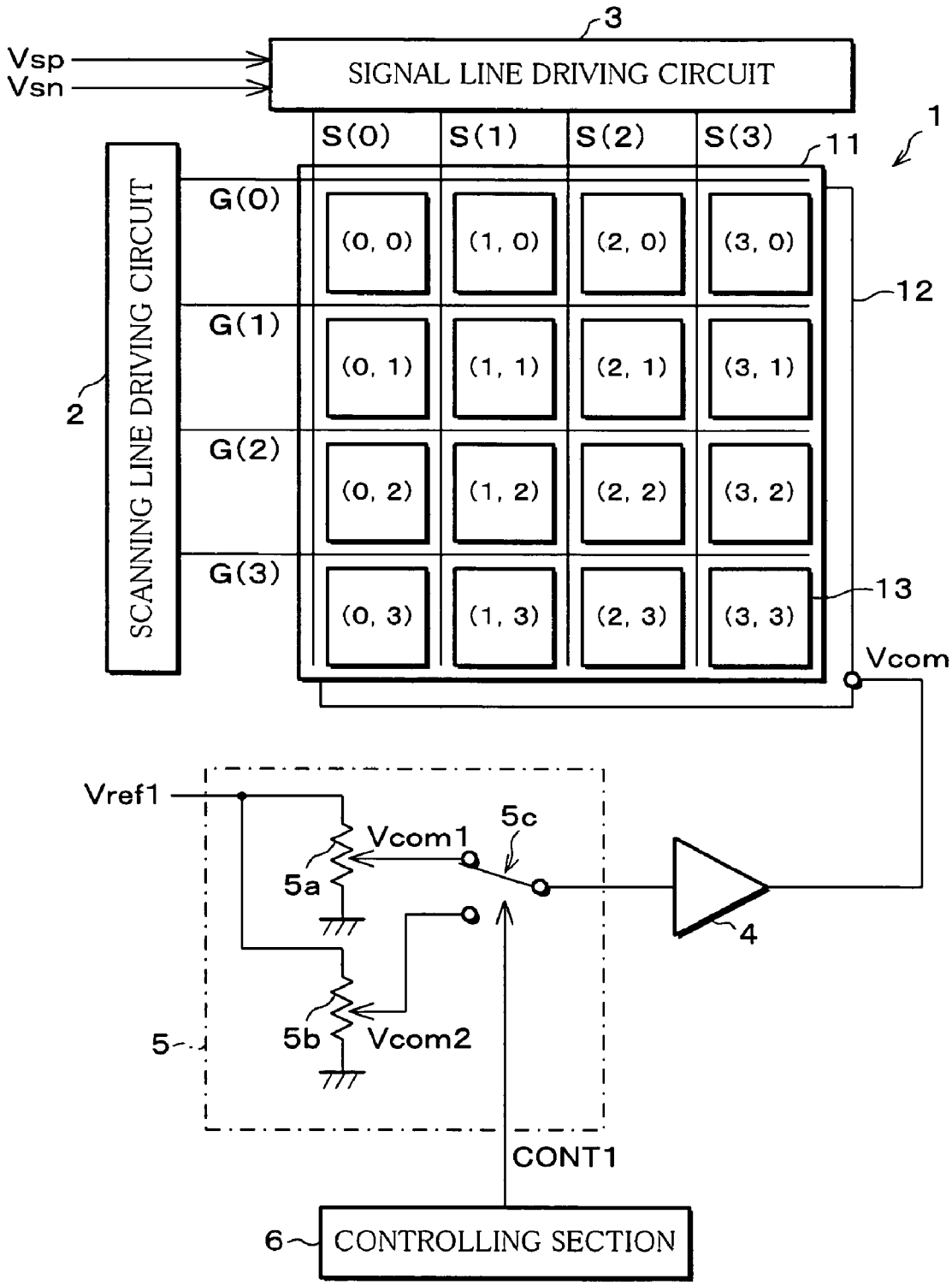
FIG. 1 is a block diagram showing a structure of a liquid crystal display device according to the first embodiment of the present invention.

A liquid crystal display device according to the present embodiment, as shown in FIG. 1, includes a liquid crystal panel 1, a scanning line driving circuit 2, a signal line driving circuit 3, and a buffer circuit 4, as in the conventional liquid crystal display device described above, and further includes an offset voltage setting section 5 and a controlling section 6.

The liquid crystal panel 1 includes a matrix substrate 11, a facing substrate 12 provided so that it faces the matrix substrate 11 in parallel, liquid crystal (not shown) filled between the both substrates 11 and 12. There are a plurality of scanning lines G(0) to G(3) and a plurality of signal lines S(0) to S(3) which cross each other and display cells 13 provided in a matrix manner on the matrix substrate 11.

Figure 20:
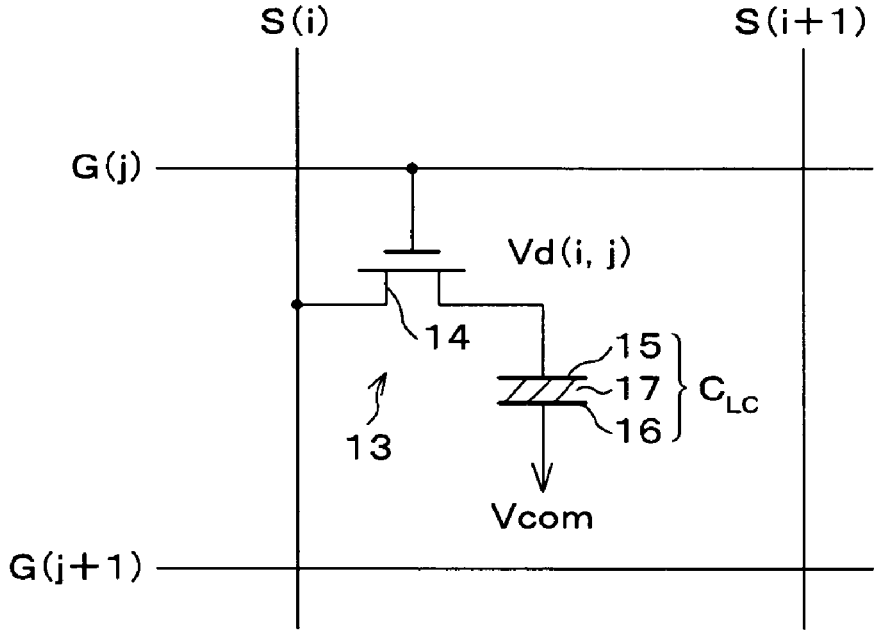
FIG. 20 is an equivalent circuit diagram showing a structure of a display cell in the liquid crystal display device of the prior art and the present invention.
Figure 21:
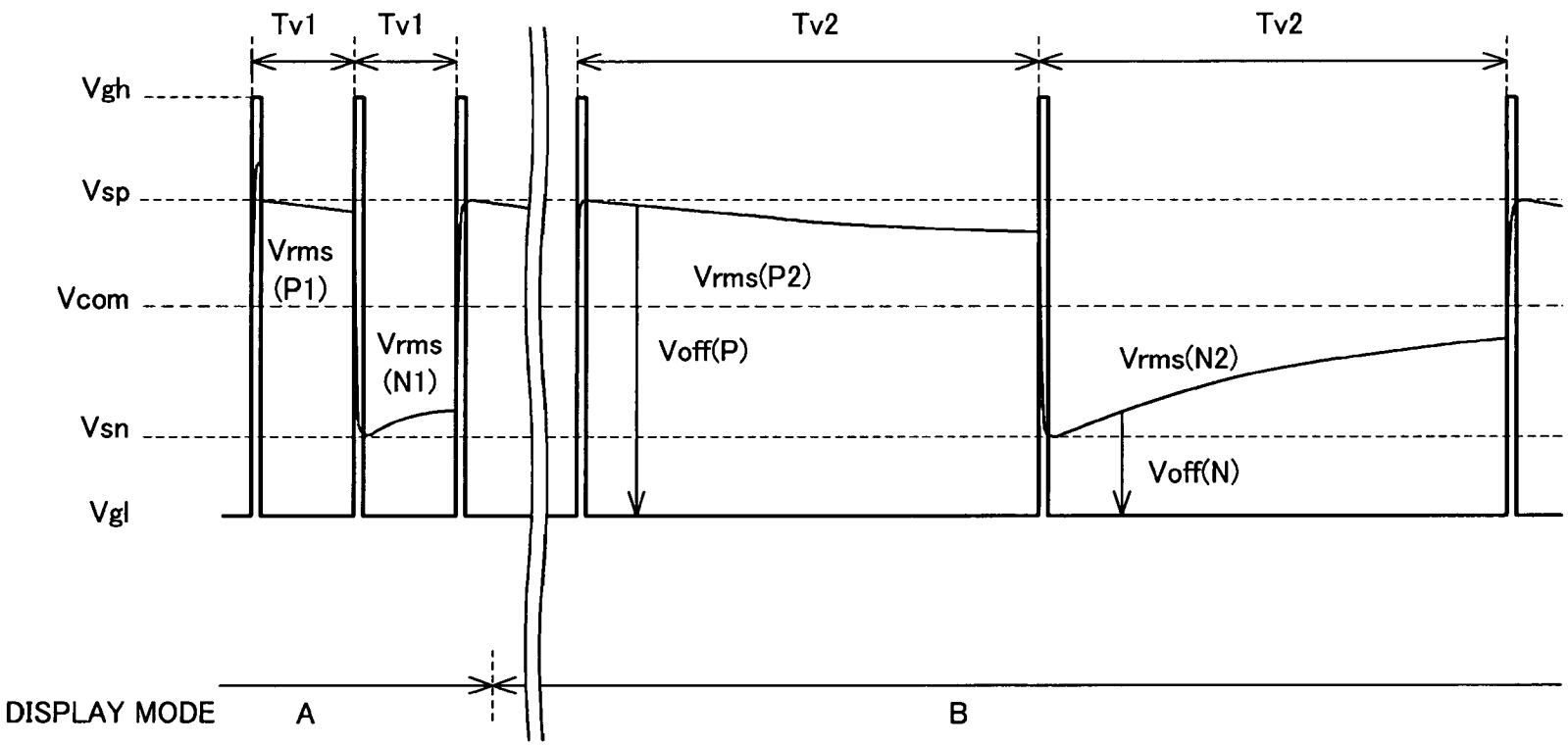
FIG. 21 PRIOR ART
FIG. 21 is a wave-form figure showing a driving operation of the conventional liquid crystal display device.
Figure 22:
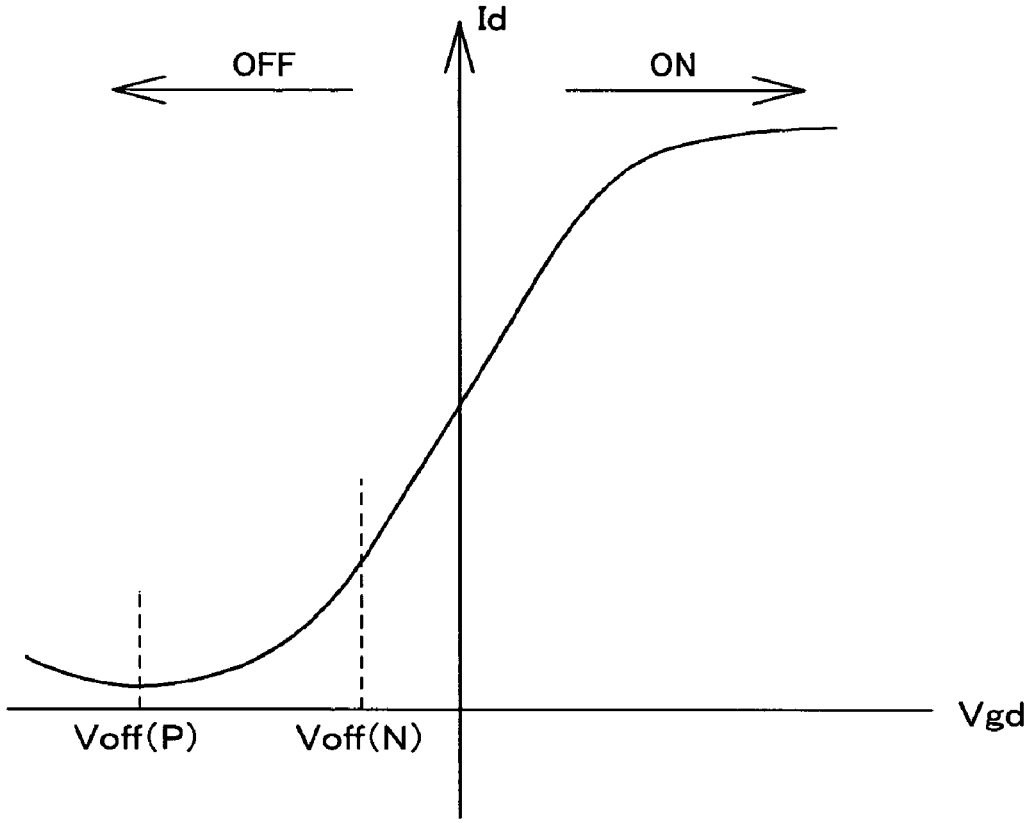
FIG. 22 is a graph showing a general operation characteristic of a TFT.

The display cell 13, as shown in FIG. 20, is provided in an area which is surrounded by two adjacent scanning lines G(j) and G(j+1) and two adjacent signal lines S(i) and S(i+1). The display cell 13 are made up of a thin film transistor (hereinbelow referred to as TFT) 14 which is a switching element, and a liquid capacitance CLC. Note that, although there is a panel which is provided with an auxiliary capacitance in parallel with the liquid crystal capacitance CLC so that the display cell includes the auxiliary capacitance, an explanation thereof is omitted here so as to simplify the description.

A gate of the TFT 14 is connected to the scanning line G(j), and a source of the TFT 14 is connected to the signal line S(i). A signal voltage V sp for positive polarity and a signal voltage V sn for negative polarity are provided to the signal line S(i). Note that, although there is a case where respective voltages for positive polarity and for negative polarity are required when plural gradations are displayed, an explanation thereof is omitted here so as to simplify the description.

The liquid crystal capacitance CLC is made up of a display electrode 15 which is connected to the drain of the TFT 14, a counter electrode 16 which faces the display electrode 15, and the liquid crystal 17 exists between the both electrodes 15 and 16. Of them, the counter electrode 16 is provided on the foregoing facing substrate 12 (see FIG. 1) so that the counter electrode 16 solely corresponds to all the display cells 13.

In the display cell 13 like this, the display electrode 15 is connected via the drain and the source of the TFT 14 to the signal line S(i), and the gate of the TFT 14 is connected to the scanning line G (j). Further, the common voltage V com which is outputted from the buffer circuit 4 shown in FIG. 1 is applied to the counter electrode 16. In this way, a voltage which is applied to the signal line S(i) is applied to the display electrode 15 while the TFT is ON, and a potential difference between the voltage and the common voltage V com which is applied to the counter electrode 16 changes the transmittance or the reflection ratio of the liquid crystal, and an image corresponding to the inputted data is displayed on the display cells 13. Further, in respective display cells 13, a charge accumulated in the liquid crystal capacitance CLC is stored for a given period, so that the image is kept displayed corresponding to the maintenance of the charge even when the TFT 14 is OFF.

The scanning line driving circuit 2 shown in FIG. 1 shifts a start pulse given from outside at a clock timing, and further, outputs a gate pulse for selecting the scanning lines G(0) to G(3) which is described later via the buffer circuit (not shown) provided within. While, the signal line driving circuit 3 shifts a start pulse given from outside at a clock timing, and samples image data based on the shift pulse. Thereafter, the image data is held, and the image data of one line is outputted via the buffer circuit (not shown) provided within to the scanning lines S(0) to S(3).

The offset setting section 5 includes resistances 5*a* and 5*b*, and a switch 5*c*. In each resistance 5*a* and 5*b* which functions as voltage setting means, the d.c. standard potential V ref1 is applied to an end and the other end is grounded. Further, the resistances 5*a* and 5*b* are variable resistances, so that they can adjust the offset, and the first voltage V com1 and the second voltage V com2 are supplied from taps of the resistances 5*a* and 5*b* respectively. The first voltage V com1 is inputted to one connecting point of two connecting points of the switch 5*c*, and the second voltage V com2 is inputted to the other connecting point of the switch 5*c*. In the switch 5*c*, the connecting points are switched by a controlling signal CONT1 which is transmitted from the controlling section 6 described later, and any one of the first voltage V com1 and the second voltage V com2 which are inputted to the switch 5 are outputted to the buffer circuit 4.

The buffer circuit 4 outputs one inputted voltage out of the first voltage V com1 and the second voltage V com2 as the common voltage V com to the counter electrode 16. The first voltage V com1 becomes a voltage level of the common voltage V com in the case of the display mode A for performing the high-speed refresh. The second voltage V com2 becomes a voltage level of the common voltage V com in the case of the display mode B for performing the low-speed refresh.

The controlling section 6 is a system controller including a CPU etc., and has a function for switching the display mode A/the display mode B. For example, in a case where the present liquid crystal display device is applied to a cellular phone, in the display mode A, a refresh operation is performed at high speed under normal displaying condition such as a condition in speaking. Further, in the display mode B, a refresh operation is performed at low speed under minimum displaying condition such as a standby condition.

Further, in a general liquid crystal display device used in a television or a monitor of a computer, the following display modes A and B may be used. For example, there is a case where the display modes A and B are switched when the display modes are changed by a computer display, or when a TV display mode (NTSC and PAL) is switched. In addition to this, the display modes A and B are switched in low-frequency driving and cessation driving both of which are performed so that power can be saved.

Here, a switching operation of the common voltage V com in the liquid crystal display device which is arranged as above is described.

Figure 2:
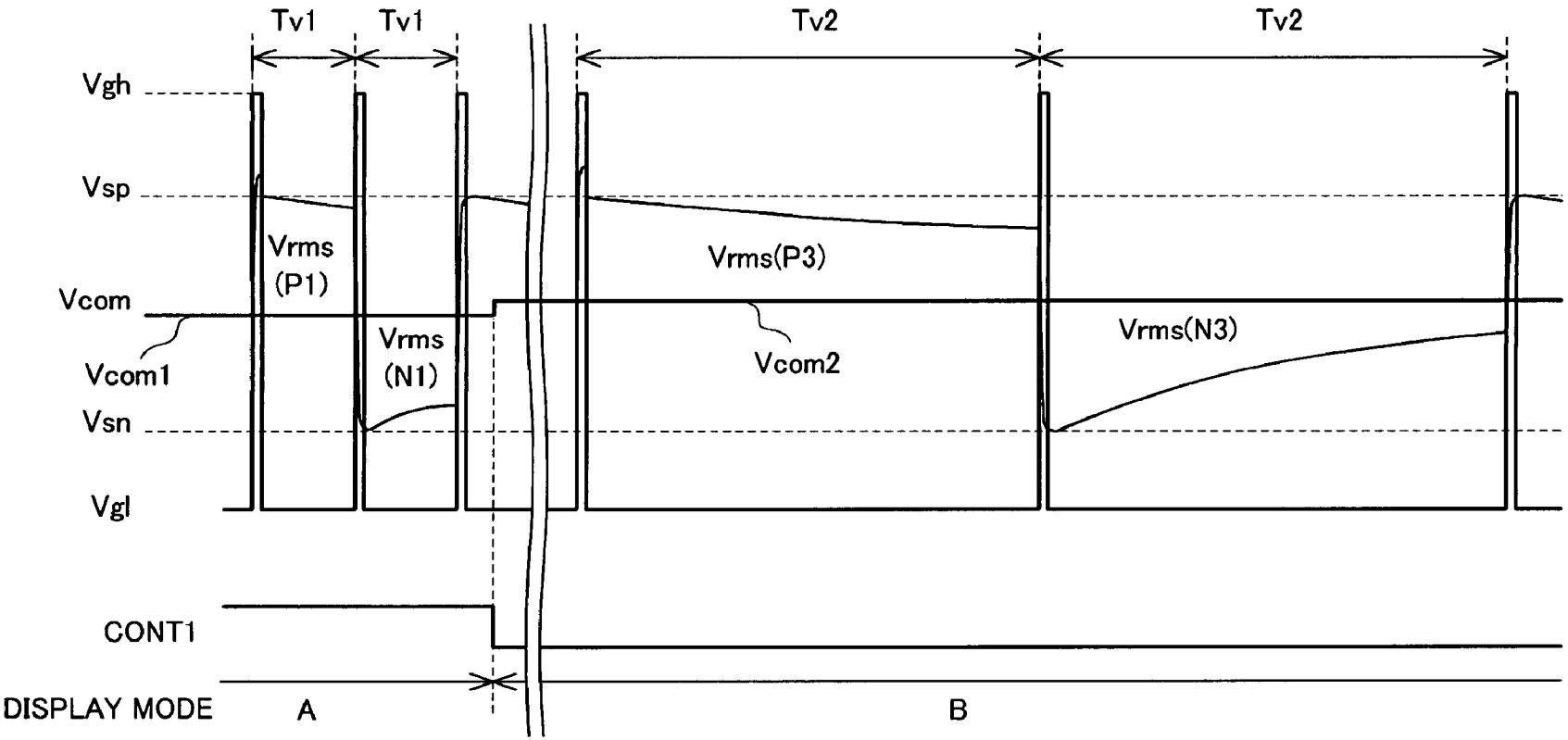
FIG. 2 is a wave-form figure showing a driving operation of the liquid crystal display device.

Based on an arbitrary display cell 13, a case where the liquid crystal 17 is a.c. driven per applying scanning of the display cell 13 is described. As shown in FIG. 2, in the display mode A, when gate pulses (gate ON voltage V gh, gate OFF voltage V gl) of potential differences (V gh to V gl) are outputted from the scanning line driving circuit 2 to the scanning line G(j) in the first refresh period T v1, the TFT 14 is ON. Thus, the signal voltage V sp of positive polarity which is being outputted from the signal line driving circuit 3 to the signal line S(i) in this while is applied to the display cell 13. Thereafter, the signal voltage V sp is stored by the liquid crystal capacitance CLC. In the next refresh period T v1, the signal voltage V sn of negative polarity which is being outputted from the signal line driving circuit 3 to the signal line S(i) is applied to the display cell 13 and stored in the same manner, while the TFT 14 is ON.

In the offset voltage setting section 5, the switch 5*c* is switched to the side of the resistance 5*a* by the controlling signal CONT1 of "H" level transmitted from the controlling section 6 in the display mode A. By this, the first voltage V com1 is selected as the common voltage V com, and is applied to the counter electrode 16. Then, the effective voltage V rms(P1) which is determined in accordance with the first voltage V com1 and is applied to the liquid crystal 17 in the first refresh period T v1 is almost equal to the effective voltage V rms(N1) which is applied to the liquid crystal 17 in the next refresh period T v1.

While, in the display mode B, as in the display mode A, the signal voltage V sp is applied and stored in the first refresh period T v2, and the signal voltage V sn is applied and stored in the next refresh period T v2. However, in the offset voltage setting section 5, the switch 5*c* is switched to the side of the resistance 5*b* by the controlling signal CONT1 of "L" level transmitted from the controlling section 6 in the display mode B. By this, the common voltage V com is switched to the second voltage V com2 which is higher than the first voltage V com1, and is applied to the counter electrode 16. Then, an effective voltage V rms(P3) which is determined in accordance with the second voltage V com2 and is applied to the liquid crystal 17 in the first refresh period T v2 is almost equal to an effective voltage V rms(N3) which is applied to the liquid crystal 17 in the next refresh period T v2.

Thus, in the liquid crystal display device of the present embodiment, in the offset voltage setting section 5, a level of the common voltage V com is switched in the display mode A and the display mode B in which the refresh periods T v1 and T v2 are different in the length. By this, different common voltages V com (the first and second voltages V com1 and V com2) are set in the refresh periods T v1 and T v2 respectively. Thus, respective common voltages V com in the display modes A and B are set appropriately as described above, so that it is possible to clear almost all the imbalance between the effective voltage of positive polarity and the effective voltage of negative polarity. And the imbalance occurs because the amount of the leak discharge differs in the display mode A and in the display mode B when the TFT 14 is OFF. As a result, it is possible to suppress the flicker which occurs in a displayed image, so that it is possible to improve the quality of the displayed image.

Note that, in the present embodiment, although a storage capacitor includes only the liquid crystal capacitance CLC, the storage capacitor may be arranged by combining the liquid crystal capacitance CLC and the auxiliary capacitance. Further, an electrode structure may be a structure such as an IPS mode in which the counter electrode 16 is provided on the matrix substrate 11.

Next, a modification example of the present embodiment is described.

Figure 3:
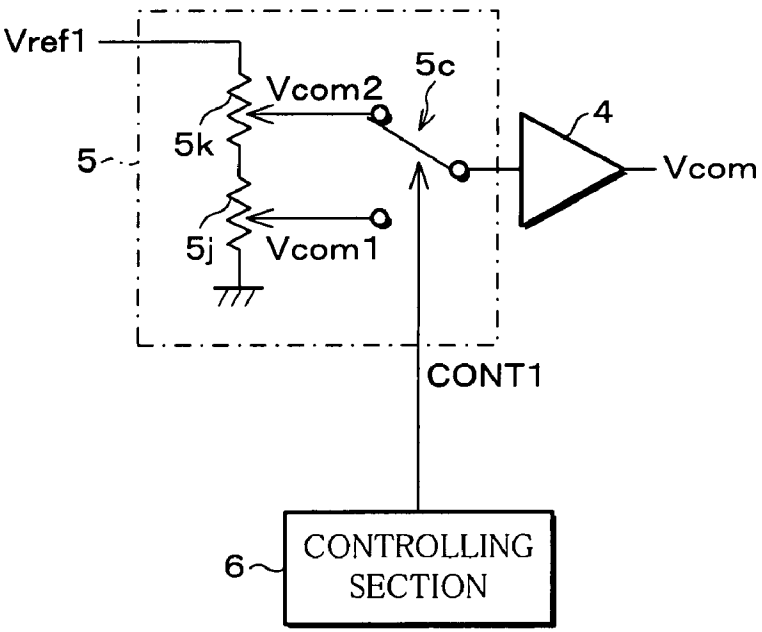
FIG. 3(*a*) and FIG. 3(*b*) are circuit diagrams showing other structures of an offset voltage setting section of the liquid crystal display device of FIG. 1.
Figure 3:
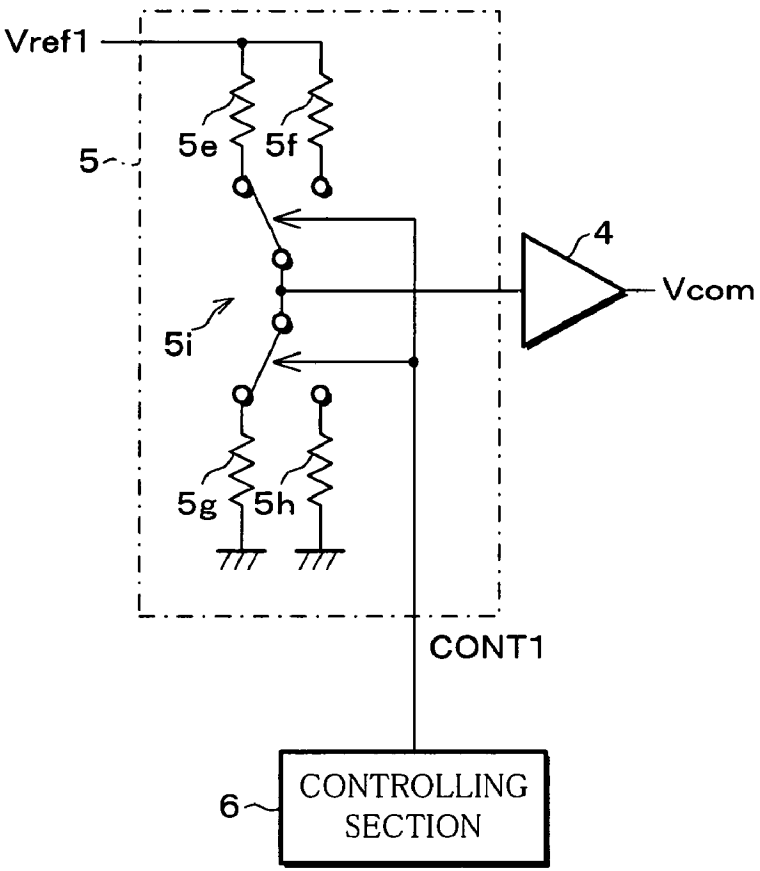

In the liquid crystal display device according to the present modification example, as shown in FIG. 3(*a*), the offset voltage setting section 5 includes resistances 5*e* to 5*h* which function as voltage setting means instead of the foregoing resistances 5*a* and 5*b*, and includes a switch 5*i* instead of the foregoing switch 5*c*. The switch 5*i* is arranged so that a pair of switches having two connecting points are provided in positive.

The standard potential V ref1 is applied to an end of the resistance 5*e* and an end of the resistance 5*f*, and another end of the resistance 5*e* and another end of the resistance 5*f* are connected to different connecting points provided on one side of the switch 5*i*. While, in each resistance 5*g* and 5*h*, an end is grounded and the other end is connected to each different connecting point provided on another side of the switch 5*i*.

When the controlling signal CONT1 is "H" level, the switch 5*i* connects respective connecting points which are connected to the resistances 5*e* and 5*g* to the buffer circuit 4. Further, when the controlling signal CONT1 is "L" level, the switch 5*i* connects respective connecting points which are connected to the resistances 5*f* and 5*h* to the buffer circuit 4.

According to the structure, the offset voltage setting section 5 is arranged so that the switch 5*i* connects the resistances 5*e* and 5*g* in positive in the display mode A, so that the standard potential Vref1 is divided by the resistances 5*e* and 5*g*, and the first voltage Vcom1 is obtained. While, in the display mode B, the switch 5*i* connects the resistances 5*f* and 5*h* in positive, so that the standard potential Vref1 is divided by the resistances 5*f* and 5*h*, and the second voltage Vcom2 is obtained.

In the structure of the offset voltage setting section 5 which uses the resistances 5*a* and 5*b* described above, even when the resistances 5*a* and 5*b* are not connected to the switch 5*c*, a current always flows in the resistances 5*a* and 5*b*. Thus, as more display modes which are different in length are set, the number of resistance setting circuits such as the resistances 5*a* and 5*b* increases. As a result, a current flows in all the resistance setting circuits, so that power consumption increases.

On the other hand, according to the foregoing structure, any one of the resistances 5*e* and 5*g*, or any one of the resistances 5*f* and 5*h* is not connected by the switch 5*i*, so that a current does not flow in the resistances which are not connected. As a result, power is not consumed. Thus, this arrangement does not allow the power consumption to increase, even when more display modes which are different in the length are set, and the number of the resistance setting circuits increases.

Further, in the liquid crystal display device according to another modification example, as shown in FIG. 3(*b*), the offset voltage setting section 5 includes resistances 5*k* and 5*j* which are connected in positive instead of the resistances 5*a* and 5*b* of FIG. 1. The resistances 5*j* and 5*k* which function as voltage setting means are variable resistances, and the first voltage V com1 and the second voltage V com2 are supplied from taps of the respective resistances. The first voltage V com1 is inputted to one connecting point of the switch 5*c*, and the second voltage V com2 is inputted to the other connecting point of the switch 5*c*.

The structure allows the offset voltage setting section 5 to connect the switch 5*c* to the resistance 5*j* on the side of a low potential in the display mode A, so that the first voltage V com1 is obtained as the common voltage V com. While, in the display mode B, the switch 5*c* is connected to the resistance 5*k* on the side of a high potential, so that the second voltage V com2 is obtained as the common voltage V com.

In the structure, even when more display modes which are different in the length are set, and more common voltage levels are required, it is possible to satisfy the requirement by increasing the number of the taps from which a signal level is supplied. This is possible because the resistances 5*j* and 5*k* are connected in positive. Thus, even when many voltage levels of the common voltage V com are required, the number of current paths does not increase, so that a power consumption does not increase.

Note that, in the present embodiment, although a resistance is used as voltage setting means, a capacitor which can divide a voltage may be used instead of the resistance. This is also the case with embodiments described below.

[Second Embodiment]

The second embodiment of the present invention is described as follows based on FIG. 4 to FIG. 6. Note that, in the present embodiment, components having the same function as the components in the first embodiment are given the same reference numerals, and descriptions thereof are omitted.

Figure 4:
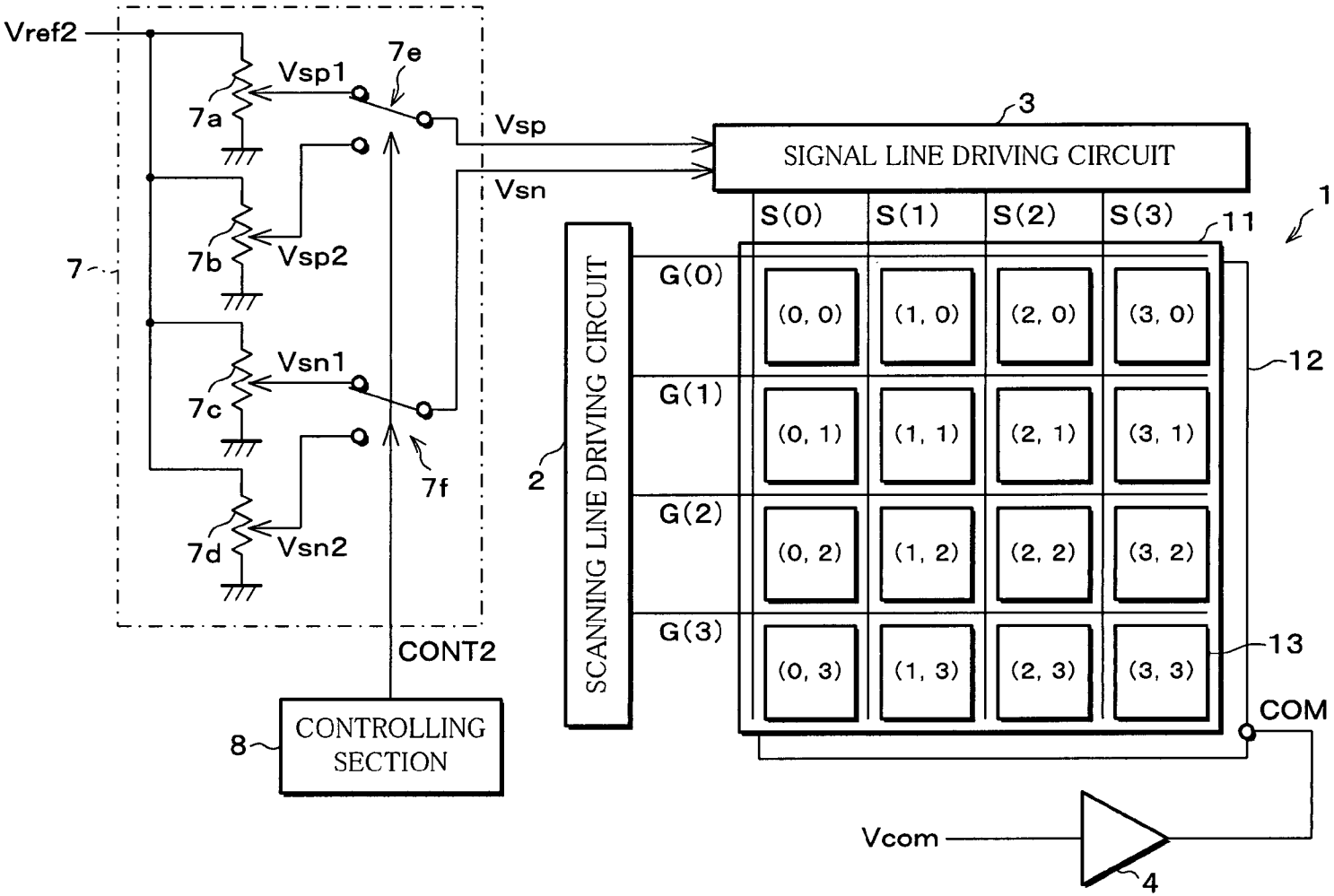
FIG. 4 is a block diagram showing a structure of the liquid crystal display device according to the second embodiment of the present invention.
Figure 5:
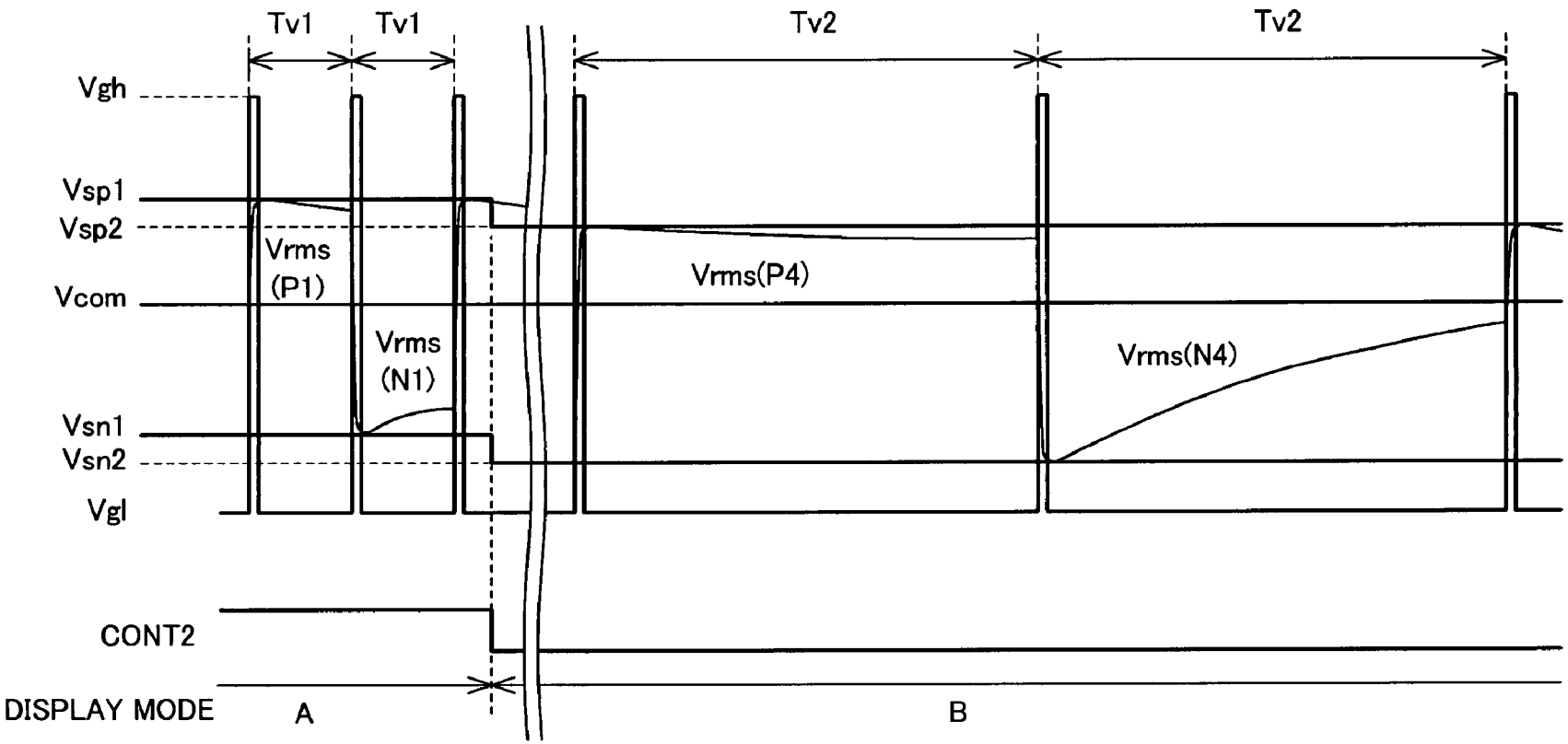
FIG. 5 is a wave-form figure showing a driving operation of the liquid crystal display device of FIG. 4.

A liquid crystal display device according to the present embodiment, as shown in FIG. 4, includes a liquid crystal panel 1, a scanning line driving circuit 2, a signal line driving circuit 3, and a buffer circuit 4 as in the liquid crystal display device of the first embodiment. Further, the present liquid crystal display device includes an offset voltage setting section 7 and a controlling section 8 instead of the offset voltage setting section 5 and the controlling section 6 (see FIG. 1). In the present liquid crystal display device, unlike the liquid crystal display device of the first embodiment, the common voltage V com applied to the counter electrode 16 (see FIG. 20) is fixed at a certain value, and the signal voltages V sp and V sn given to the signal line driving circuit 3 are offset with them corresponding to the display mode.

The offset voltage setting section 7 includes resistances 7*a* to 7*d* and switches 7*e* and 7*f*. In each resistance 7*a* to 7*d* as voltage setting means, the standard potential V ref2 is applied to an end, and the other end is grounded. Further, resistances 7*a* to 7*d* are variable resistances, so that it is possible to adjust the offset, and the first voltage V sp1, the second voltage V sp2, the first voltage V sn1, and the second voltage V sn2 are supplied from respective taps.

The first voltage V sp1 is inputted to one connecting point of the switch 7*e*, and the second voltage V sp2 is inputted to the other connecting point of the switch 7*e*. The switch 7*e* switches any one of the first voltage V sp1 and the second voltage V sp2 and outputs the switched voltage to the signal driving circuit 3 in accordance with a controlling signal CONT 2 transmitted from the controlling section 8 which is described later.

While, the first voltage Vsn1 is inputted to one connecting point of the switch 7*f*, and the second voltage Vsn2 is inputted to the other connecting point of the switch 7*f*. The switch 7*f* switches any one of the first voltage V sn1 and the second voltage V sn2 which are inputted in synchronism with the switch 7*e* and outputs the switched voltage to the signal driving circuit 3 in accordance with the controlling signal CONT 2 transmitted from the controlling section 8.

The controlling section 8 is a system controller including a CPU etc., and has a function for switching for the display mode A/the display mode B as in the controlling section 6 (see FIG. 1) of the first embodiment. The controlling section 8 outputs the controlling signal CONT 2 of "H" level when the display mode A is set, and outputs the controlling signal CONT 2 of "L" level when the display mode B is set.

The following is a description of a switching operation of the signal voltages Vsp and Vsn in the liquid crystal display device arranged in the foregoing manner.

Based on an arbitrary display cell 13, a case where the liquid crystal 17 is a.c. driven in ever applying scanning of the display cell 13 is described. As shown in FIG. 5, in the display mode A, when gate pulses (gate ON voltage V gh, gate OFF voltage V gl) of potential differences (V gh to V gl) are outputted from the scanning line driving circuit 2 to the scanning line G(j) in the first refresh period T v1, the TFT 14 is ON. Thus, the signal voltage V sp of positive polarity which is being outputted from the signal line driving circuit 3 to the signal line S(i) in this while is applied to the display cell 13. Thereafter, the signal voltage V sp is stored by the liquid crystal capacitance CLC. In the next refresh period T v1, the signal voltage V sn of negative polarity which is being outputted from the signal line driving circuit 3 to the signal line S(i) is applied to the display cell 13 and stored in the same manner, while the TFT 14 is ON.

In the offset voltage setting section 7, the switches 7*e* and 7*f* are switched to the side of the resistances 7*a* and 7*c* by the controlling signal CONT2 of "H" level transmitted from the controlling section 8 in the display mode A. By this, the first voltages Vsp1 and Vsn1 are selected as the signal voltages Vsp and Vsn, and are applied to the signal driving circuit 3. Then, the effective voltage V rms(P1) which is determined in accordance with the first voltages Vsp1 and Vsn1 and is applied to the liquid crystal 17 in the first refresh period T v1 is almost equal to the effective voltage V rms(N1) which is applied to the liquid crystal 17 in the next refresh period T v1.

While, in the display mode B, as in the display mode A, the signal voltage V sp is applied and stored in the first refresh period T v2, and the signal voltage V sn is applied and stored in the next refresh period T v2. However, in the offset voltage setting section 7, the switches 7*e* and 7*f* are switched to the side of the resistances 7*b* and 7*d* by the controlling signal CONT2 of "L" level transmitted from the controlling section 8 in the display mode B. By this, the signal voltages Vsp and Vsn are switched to the second voltages Vsp2 and V sn2 which are lower than the first voltages Vsp1 and V sn1, and are applied to the signal line driving circuit 3. Then, an effective voltage V rms(P4) which is determined in accordance with the second voltages Vsp2 and V sn2 and is applied to the liquid crystal 17 in the first refresh period T v2 is almost equal to an effective voltage V rms(N4) which is applied to the liquid crystal 17 in the next refresh period T v2.

Thus, in the liquid crystal display device of the present embodiment, in the offset voltage setting section 7, a level of the signal voltage Vsp and Vsn are switched in the display mode A and the display mode B in which the refresh periods T v1 and T v2 are different in the length. By this, different signal voltages Vsp and Vsn (the first voltages Vsp1 and Vsn1, and the second voltages Vsp2 and Vsn2) are set in the refresh periods T v1 and T v2 respectively. Thus, respective signal voltages Vsp and Vsn are set appropriately as described above, so that it is possible to clear almost all the imbalance between the effective voltage of positive polarity and the effective voltage of negative polarity. And the imbalance occurs because the amount of the leak discharge differs in the display mode A and in the display mode B when the TFT 14 is OFF. As a result, it is possible to suppress the flicker which occurs in a displayed image, so that it is possible to improve the quality of the displayed image.

Next, a modification example of the present embodiment is described.

Figure 6:
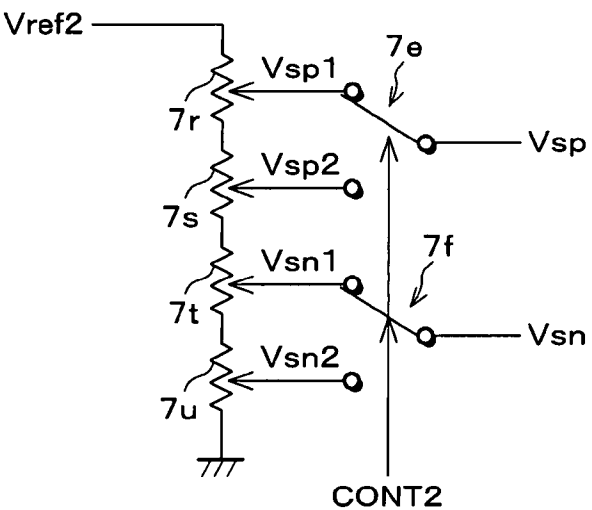
FIG. 6(*a*) and FIG. 6(*b*) are circuit diagrams showing other structures of the offset voltage setting section of the liquid crystal display device of FIG. 4.
Figure 6:
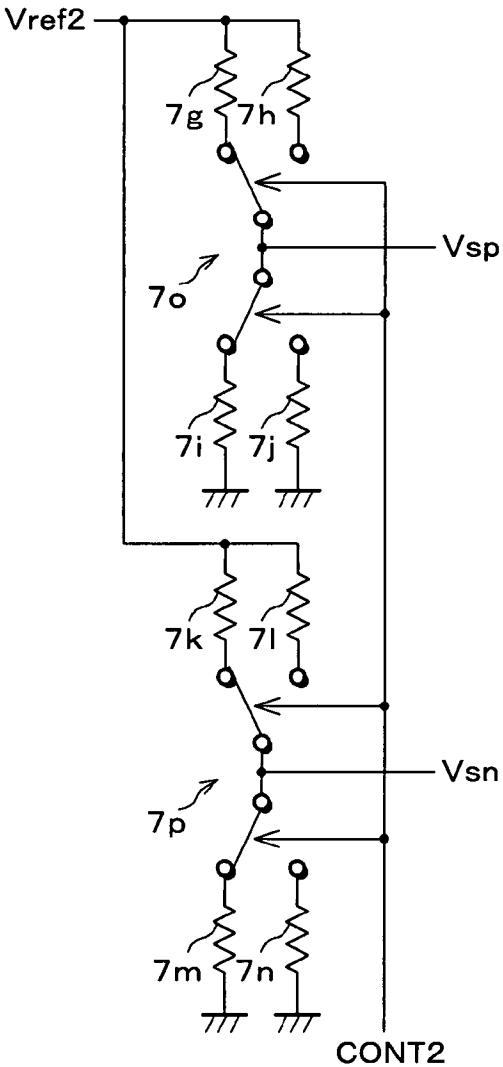

Also in the liquid crystal display device according to the present modification example, the offset voltage setting section 7 can be arranged as shown in FIG. 6(*a*) and FIG. 6(*b*). Specifically, as shown in FIG. 6(*a*), the offset voltage setting section 7 includes resistances 7*g* to 7*n* which function as voltage setting means instead of the foregoing resistances 7*a* and 7*d*, and includes a switches 7*o* and 7*p* instead of the switches 7*e* and 7*f*. The switches 7*o* and 7*p* are arranged so that two pairs of switches having two connecting points are provided in positive.

According to the structure, in the offset voltage setting section 7, the switch 7*o* connects the resistances 7*g* and 7*i* in positive by the controlling signal CONT2 of "H" level, and the switch 7*p* connects the resistances 7*k* and 7*m* in positive, so that the standard potential Vref2 is divided by the resistances 7*g* and 7*i* and the resistances 7*k* and 7*m* respectively, and the first voltages Vsn1 and Vsp1 are obtained in the display mode A.

While, the switch 7*o* connects the resistances 7*h* and 7*j* in positive by the controlling signal CONT2 of "L" level, and the switch 7*p* connects the resistances 7*l* and 7*n* in positive, so that the standard potential Vref2 is divided by the resistances 7*h* and 7*j* and the resistances 7*l* and 7*n* respectively, and the second voltages Vsn2 and Vsp2 are obtained in the display mode B.

Further, the liquid crystal display device according to another modification example, as shown in FIG. 6(*b*), the offset voltage setting section 7 includes resistances 7*r* to 7*u* provided in positive instead of the resistances 7*a* to 7*d* of FIG. 4. The resistances 7*r* to 7*u* as voltage setting means are variable resistances, and the first voltage Vsp1, the second voltage Vsp2, the first voltage Vsn1, and the second voltage Vsn2 are supplied from taps of the respective resistances. The first voltages Vsp1 and Vsn1 are inputted to one connecting point of each switch 7*e* and 7*f*, and the second voltages Vsp2 and Vsn2 are inputted to the other connecting point of each switch 7*e* and 7*f*.

According to the structure, in the offset voltage setting section 7, the switches 7*e* and 7*f* are connected to the resistances 7*r* and 7*t*, so that the first voltages Vsp1 and Vsn1 are obtained in the display mode A. While, in the display mode B, the switches 7*e* and 7*f* are connected to the resistances 7*s* and 7*u*, so that the second voltages Vsp2 and Vsn2 are obtained in the display mode B.

In the structures shown in FIG. 6(*a*) and FIG. 6(*b*), as in the structures of FIG. 3(*a*) and FIG.3(*b*), when the signal voltages Vsp and Vsn are not outputted, the number of current paths in which a current flows is not increased, even in a case where more display modes which are different in the length are set and more voltage levels are required as the signal voltages Vsp and Vsn since. Thus, power consumption does not increase.

Further, in the liquid crystal display device according to another modification example, any one of the signal voltages Vsp and V sn is solely offset, and the other is fixed at a certain value. The liquid crystal display device can be realized by arranging so that in the offset voltage setting section 7 of FIG. 4, for example, the resistance 7*b* and the switch 7*e* are omitted, and the signal voltage Vsp is obtained from the resistance 7*a* directly.

Figure 7:
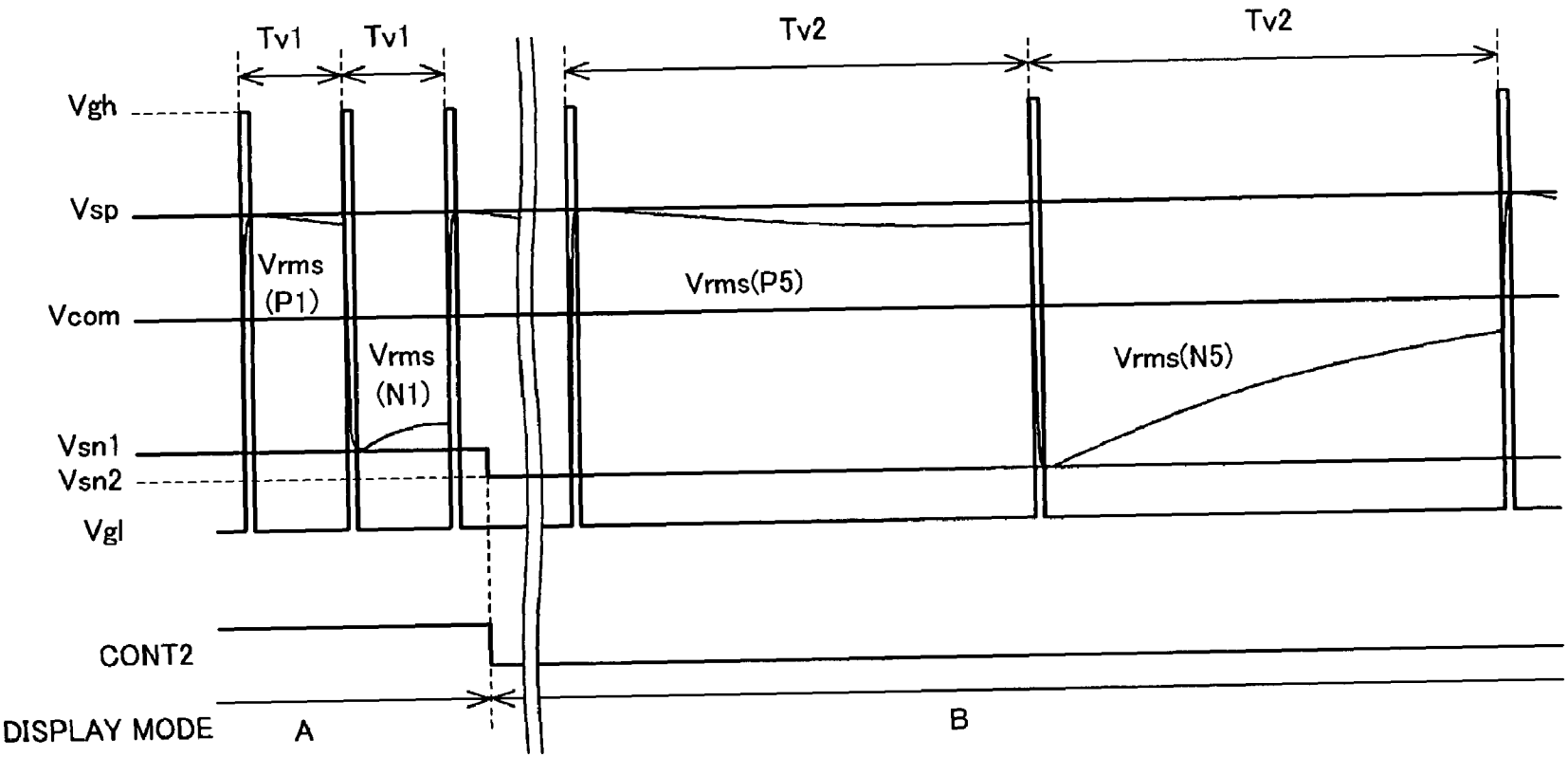
FIG. 7 is a wave-form figure showing a driving operation of the liquid crystal display device according to a modification example of the second embodiment of the present invention.

In the liquid crystal display device, as shown in FIG. 7, in the first refresh period Tv2 in the display mode B, a constant signal voltage Vsp is applied and stored, and in the next refresh period Tv2, a signal voltage Vsn which is switched from the first voltage Vsn1 of the display mode A to the second voltage Vsn2 of the display mode B is applied and stored.

In the liquid crystal display device, the signal voltage Vsp is fixed to a certain value, so that amount of the offset signal voltage Vsn (absolute value of the difference between the first voltage Vsn1 and the second voltage Vsn2) is set so that an effective voltage Vrms(P5) is equal to an effective voltage Vrms(N5).

Further, even when the signal voltage Vsn is fixed to a certain value, and only the signal voltage Vsp is offset, it is possible that the effective voltage Vrms(P5) is equal to the effective voltage Vrms(N5) in the same manner.

According to the structure, any one of the signal voltages Vsp and Vsn is solely offset, so that it is possible to simplify the structure of the offset voltage setting section 7, compared with the structure of FIG. 4 in which both the signal voltages Vsp and Vsn are offset.

[Third Embodiment]

The third embodiment of the present invention is described as follows based on FIG. 8 to FIG. 9. Note that, in the present embodiment, components having the same function as the components in the first and second embodiments are given the same reference numerals, and descriptions thereof are omitted.

Figure 8:
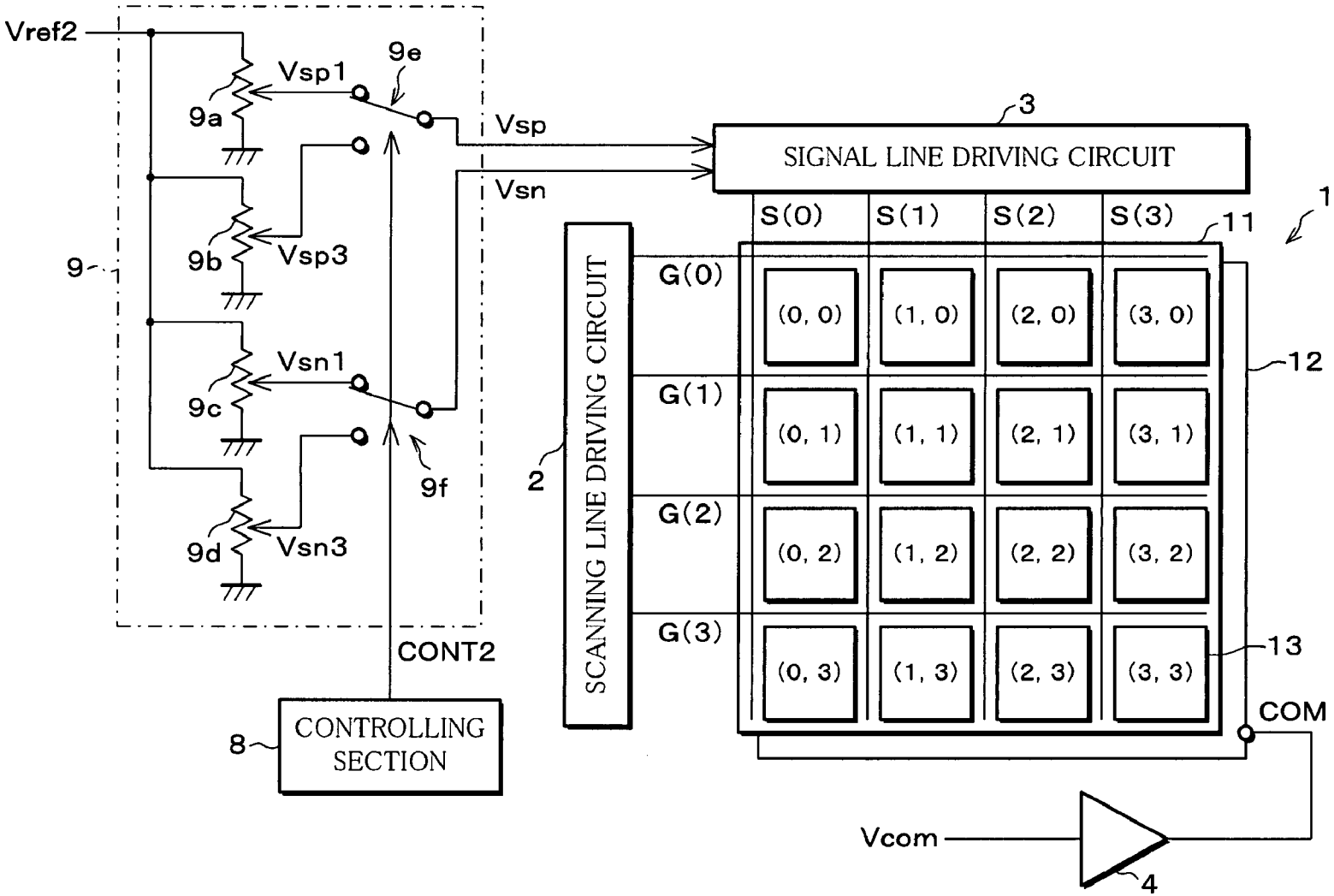
FIG. 8 is a block diagram showing a structure of the liquid crystal display device according to the third embodiment of the present invention.

A liquid crystal display device according to the present embodiment, as shown in FIG. 8, includes a liquid crystal panel 1, a scanning line driving circuit 2, a signal line driving circuit 3, a buffer circuit 4, and a controlling section 8, as in the liquid crystal display device of the second embodiment. Further, the present liquid crystal display device includes an offset voltage setting section 9 instead of the offset voltage setting section 7 of the second embodiment (see FIG. 4). The present liquid crystal display device, unlike the liquid crystal display device of the second embodiment, corrects imbalance of the effective voltages in the refresh periods Tv1 and Tv2 which is brought about by a leak current etc. when the TFT 14(see FIG. 20) is OFF in a case where the refresh period is long.

The offset voltage setting section 9 includes resistances 9*a* to 9*d* and switches 9*e* to 9*f*. In each resistance 9*a* to 9*d* as voltage setting means, the standard potential Vref2 is applied to one end, and the other end is grounded. Further, the resistances 9*a* to 9*d* are variable resistances, so that it is possible to adjust the offset. And the first voltage Vsp1, the third voltage Vsp3, the first voltage Vsn1, and the third voltage Vsn3 are supplied from taps of the respective resistances. The third voltages Vsp3 and Vsn3 differ from the second voltages Vsp2 and Vsn2 (see FIG. 5) in that, according to the length of the refresh period Tv2, it is possible to suitably increase or decrease a voltage which compensates the stored voltage dropped due to a leak current etc. which occurs when the TFT 14 is OFF in the refresh period Tv2 whose voltage storing period became longer.

The first voltage V sp1 is inputted to one connecting point of the switch 9*e*, and the third voltage V sp3 is inputted to the other connecting point of the switch 9*e*. The switch 9*e* switches any one of the first voltage V sp1 and the third voltage V sp3 and outputs the switched voltage to the signal driving circuit 3 in accordance with a controlling signal CONT 2 transmitted from the controlling section 8. While, the first voltage Vsn1 is inputted to one connecting point of the switch 9*f*, and the third voltage Vsn3 is inputted to the other connecting point of the switch 9*f*. The switch 9*f* switches any one of the first voltage V sn1 and the third voltage V sn3 which are inputted in synchronism with the switch 9*e* and outputs the switched voltage to the signal driving circuit 3 in accordance with the controlling signal CONT 2.

In the liquid crystal display device arranged in the foregoing manner, as in the liquid crystal display device of the second embodiment, a switching operation of the signal voltages Vsp and Vsn is performed by the offset voltage setting section 9. As a result, as shown in FIG. 9, in the display mode A, the first voltages Vsp1 and Vsn1 are selected as the signal voltages Vsp and Vsn in the offset voltage setting section 9, and are applied to the signal line driving circuit 3. Then, the effective voltage V rms(P1) which is determined in accordance with the first voltages Vsp1 and Vsn1 and is applied to the liquid crystal 17 in the first refresh period T v1 is almost equal to the effective voltage V rms(N1) which is applied to the liquid crystal 17 in the next refresh period T v1.

While, in the display mode B, as in the display mode A, the signal voltages V sp and Vsn are applied and stored. However, here, the third voltage Vsp3 which is higher than the first voltage Vsp1 is applied and stored in the first refresh period Tv2, and the third voltage Vsn3 which is lower than the first voltage Vsn1 is applied and stored in the next refresh period Tv2.

In the liquid crystal display device of the second embodiment, the refresh period Tv2 becomes longer, and amount of a leak current increases when the TFT 14 is OFF. As a result, the stored voltage is largely dropped in the refresh period Tv2. Thus, as shown in FIG. 5 of the second embodiment, in applying the signal voltages Vsp and Vsn whose amplitude is the same in the refresh periods Tv1 and Tv2, even when |Vrms(P1)|=|Vrms(N1)| and |Vrms(P4)|=|Vrms(N4)|, |Vrms(P1)|>|Vrms(P4)| and |Vrms(N1)|>|Vrms(N4)|. Thus, the quality of display in the refresh period Tv2 degrades.

Figure 9:
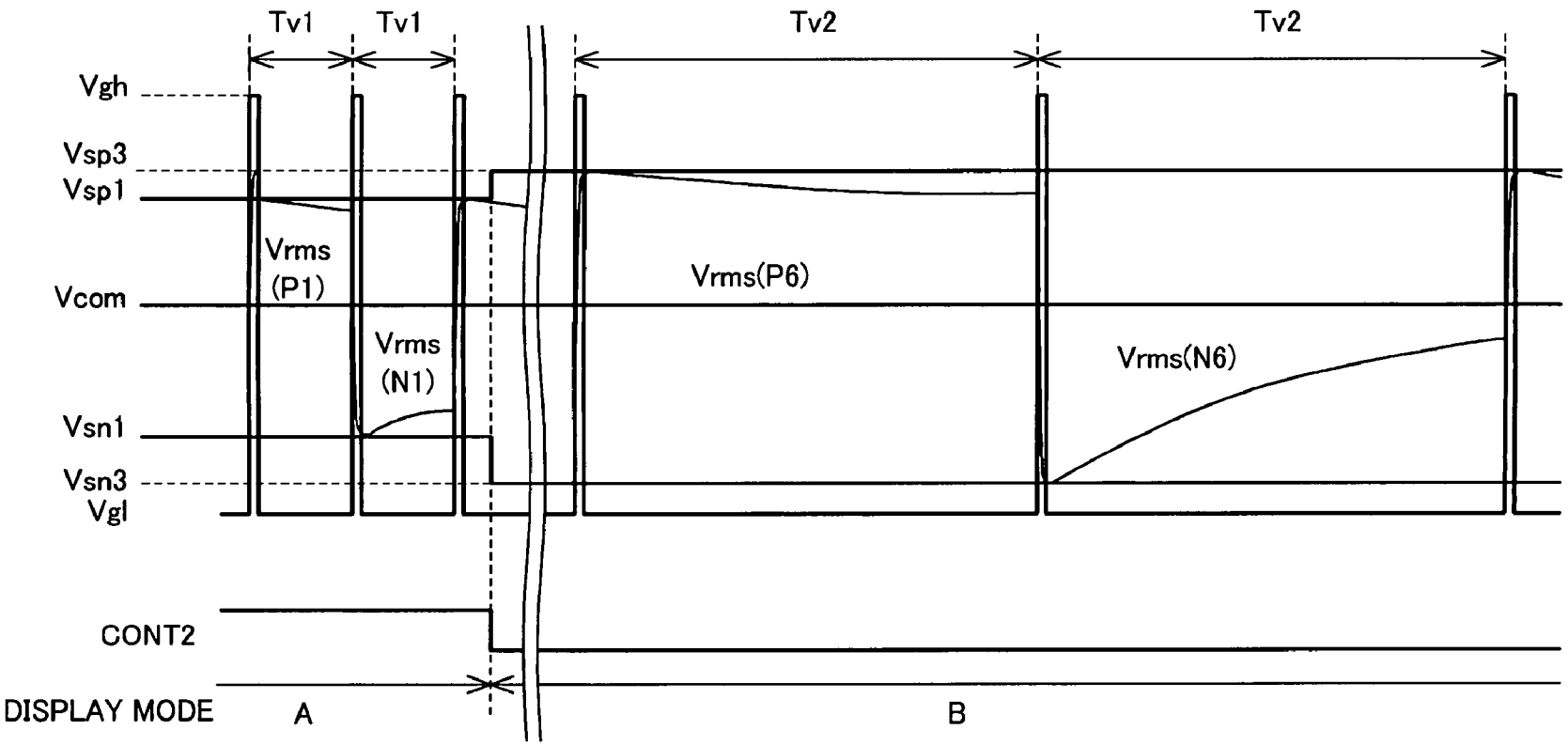
FIG. 9 is a wave-form figure showing a driving operation of the liquid crystal display device of FIG. 8.

Unlike this, in the liquid crystal display device of the present embodiment, as shown in FIG. 9, the third voltages Vsp3 and Vsn3 which include compensation of the leak current as the signal voltage are applied in the refresh period Tv2, so that the effective voltages Vrms(N1), Vrms(N6), Vrms(P1), and Vrms(P6) are equal respectively. Thus, it is possible to keep the quality of display even when the refresh periods are different in the length.

Further, the offset voltage setting section 9 of the present liquid crystal display device may be arranged as in the offset voltage setting section 7 of FIG. 6(*a*) and FIG. 6(*b*) in the second embodiment. Thus, also in the present liquid crystal display device, the number of current paths in which a current flows is not increased when the signal voltages Vsp and Vsn are not outputted. Thus, even in the case where more display modes which are different in the length are set and more voltage levels are required as the signal voltages Vsp and Vsn, the number of current paths in which a current flows is not increased. As a result, it is possible to avoid the increase of power consumption.

[Fourth Embodiment]

The fourth embodiment of the present invention is described as follows based on FIG. 10 to FIG. 12. Note that, in the present embodiment, components having the same function as the components in the first and second embodiments are given the same reference numerals, and descriptions thereof are omitted.

Figure 10:
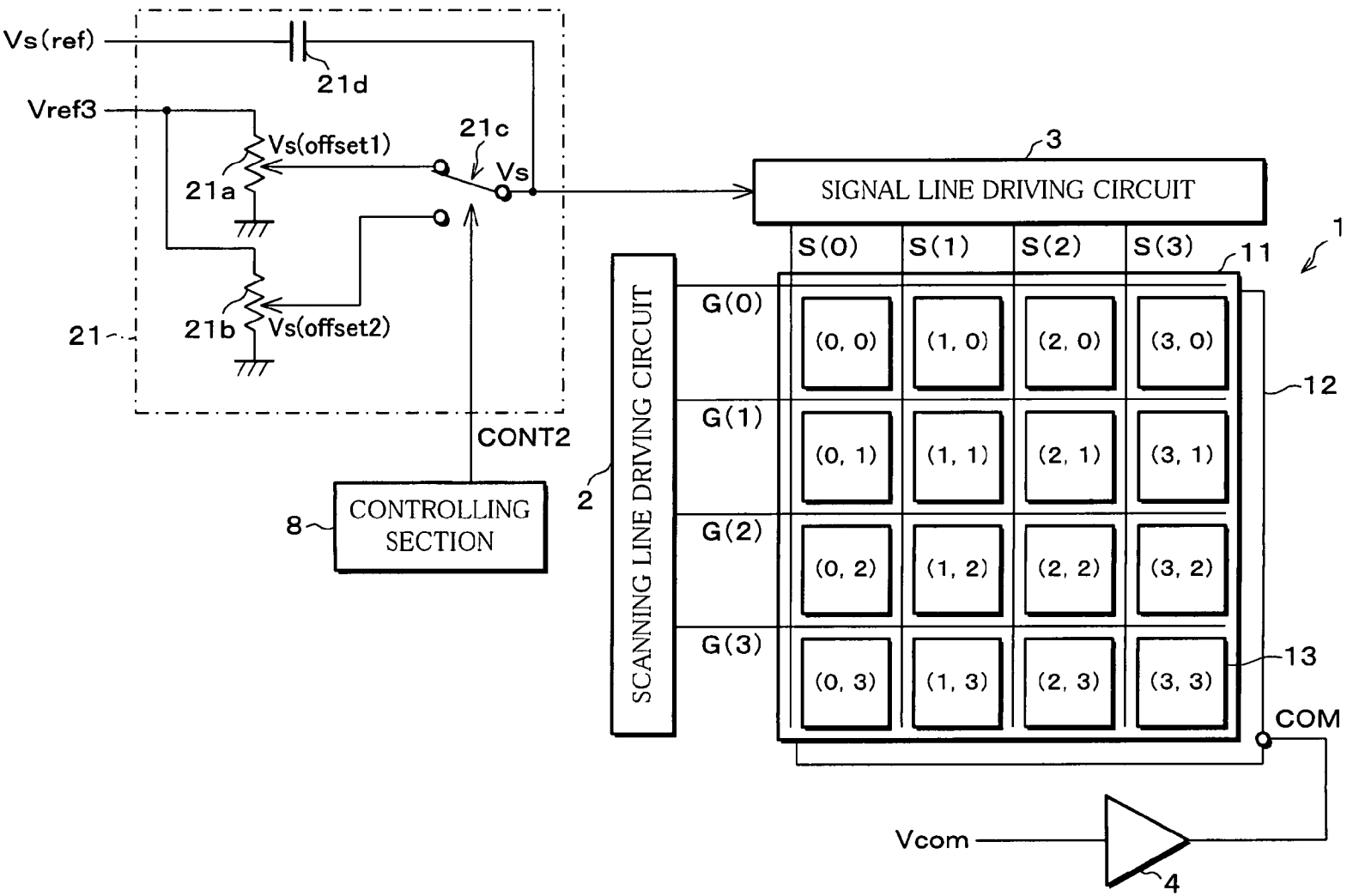
FIG. 10 is a block diagram showing a structure of the liquid crystal display device according to the fourth embodiment of the present invention.
Figure 11:
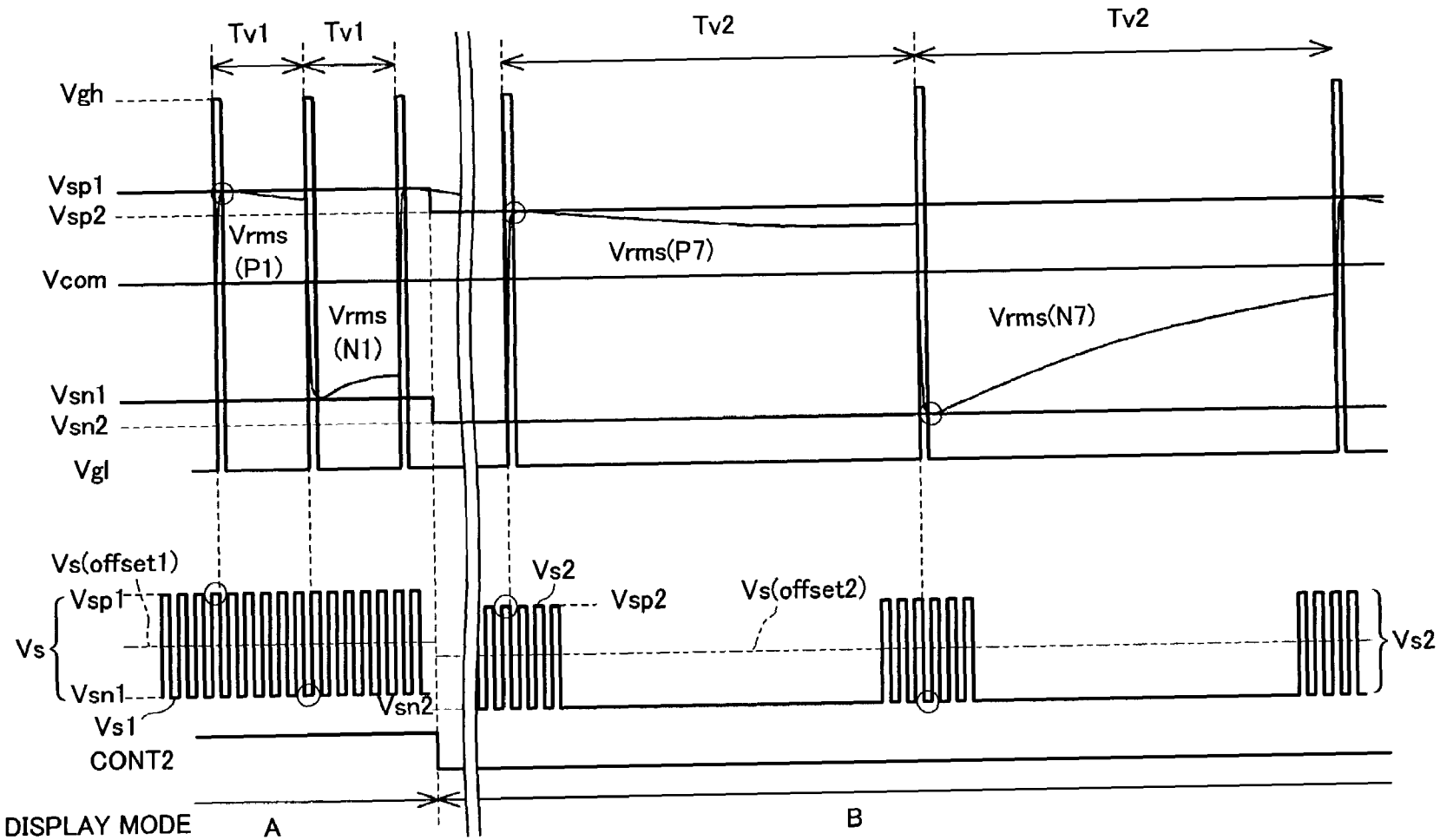
FIG. 11 is a wave-form figure showing a driving operation of the liquid crystal display device of FIG. 10.

A liquid crystal display device according to the present embodiment, as shown in FIG. 10, includes a liquid crystal panel 1, a scanning line driving circuit 2, a signal line driving circuit 3, a buffer circuit 4, and a controlling section 8, as in the liquid crystal display device of the second embodiment. Further, the present liquid crystal display device includes an offset voltage setting section 21 instead of the offset voltage setting section 7 of the second embodiment (see FIG. 4). The present liquid crystal display device, unlike the liquid crystal display device of the second embodiment, as shown in FIG. 11, reverses a level of a source signal Vs in every horizontal line, and offsets a mean potential of an amplitude of the source signal Vs, that is, the level of the source signal Vs. The source signal Vs, as described later, is generated by the offset voltage setting section 21 in accordance with a pulse signal Vs(ref) (see FIG. 10) which includes amplitude of the difference between the signal voltage Vsp (the first voltage Vsp1 and the second voltage sp2) and the signal voltage Vsn (the first voltage Vsn1 and the second voltage sn2).

As shown in FIG. 10, the offset voltage setting section 21 includes resistances 21*a* and 21*b*, a switch 21*c*, and an AC coupling capacitor 21*d*.

In each resistance 21*a* to 21*b*, the standard potential V ref3 is inputted to an end, and the other end is grounded. Further, resistances 21*a* to 21*b* are variable resistances, so that it is possible to adjust the offset, and a mean potential of an amplitude Vs(offset1) on the side of a high potential and a mean potential of an amplitude Vs(offset2) on the side of a low potential are supplied from taps of respective resistances.

The mean potential of an amplitude Vs(offset1) is inputted to one connecting point of the switch 21*c*, and the mean potential of an amplitude Vs(offset2) is inputted to the other connecting point 21*c*. The switch 21*c* switches any one of the mean potential of an amplitude Vs(offset1) and the mean potential of an amplitude Vs(offset2) and outputs the switched amplitude potential to the signal line driving circuit 3 by the controlling signal CONT2 transmitted from the controlling section 8. The AC coupling capacitor 21*d* includes amplitude of the difference between the signal voltages Vsp and Vsn on one end, and a pulse signal Vs(ref) whose polarity is judged in every horizontal line is inputted to the end. And the other end is connected to the side of the output terminal of the switch 21*c*.

According to the liquid crystal display device arranged in the foregoing manner, in the offset voltage setting section 21, a switching operation of the switch 21*c* allows any one of the mean potential of an amplitude Vs(offset1) and the mean potential of an amplitude Vs(offset2) to be outputted. Then, the pulse signal Vs(ref) whose DC component was removed by the coupling capacitor 21*d* is superposed on the outputted mean potential of an amplitude. Thus, the source signals Vs1 and Vs2 which are different in the refresh periods Tv1 and Tv2 respectively are given to the signal line driving circuit 3.

First, in the display mode A, the source signal Vs1 is selected in the offset voltage setting section 21, and is given to the signal line driving circuit 3. Then, as shown in FIG. 11, in the first refresh period Tv1, the first voltage Vsp1 (value in a circle) of the source signal Vs1 is applied and stored in a period of the gate pulse, and in the next refresh period Tv1, a voltage of the first voltage Vsn1 of the source signal Vs1 is applied and stored in the period of the gate pulse. Here, the effective voltage Vrms(P1) which is applied to the liquid crystal 17 in the first refresh period Tv1 is almost equal to the effective voltage Vrms(N1) which is applied to the liquid crystal 17 in the next refresh period Tv1 by setting a value of the first voltages Vsp1 and Vsn1.

While, in the offset voltage setting section 21, the source signal Vs2 is selected in the display mode B. Then, as in the display mode A, the second voltages Vsp2 and Vsn2 of the source signal Vs2 (value in a circle) are applied and stored. Thus, as in the liquid crystal display device of the second embodiment, the effective voltage Vrms(P7) becomes almost equal to the effective voltage Vrms(N7).

In this way, in the liquid crystal display device of the present embodiment, the source signal Vs which is reversed in every horizontal line is offset, so that it is possible to improve the quality of a displayed image as in the liquid crystal display device of the second embodiment.

Note that, in the present embodiment, although amplitude of the source signal Vs (source signals Vs1 and Vs2) is constant, amplitude of the source signals Vs1 and Vs2 may be varied. Concretely, amplitude of the source signal Vs2 is set to be larger than that of the source signal Vs1.

Figure 12:
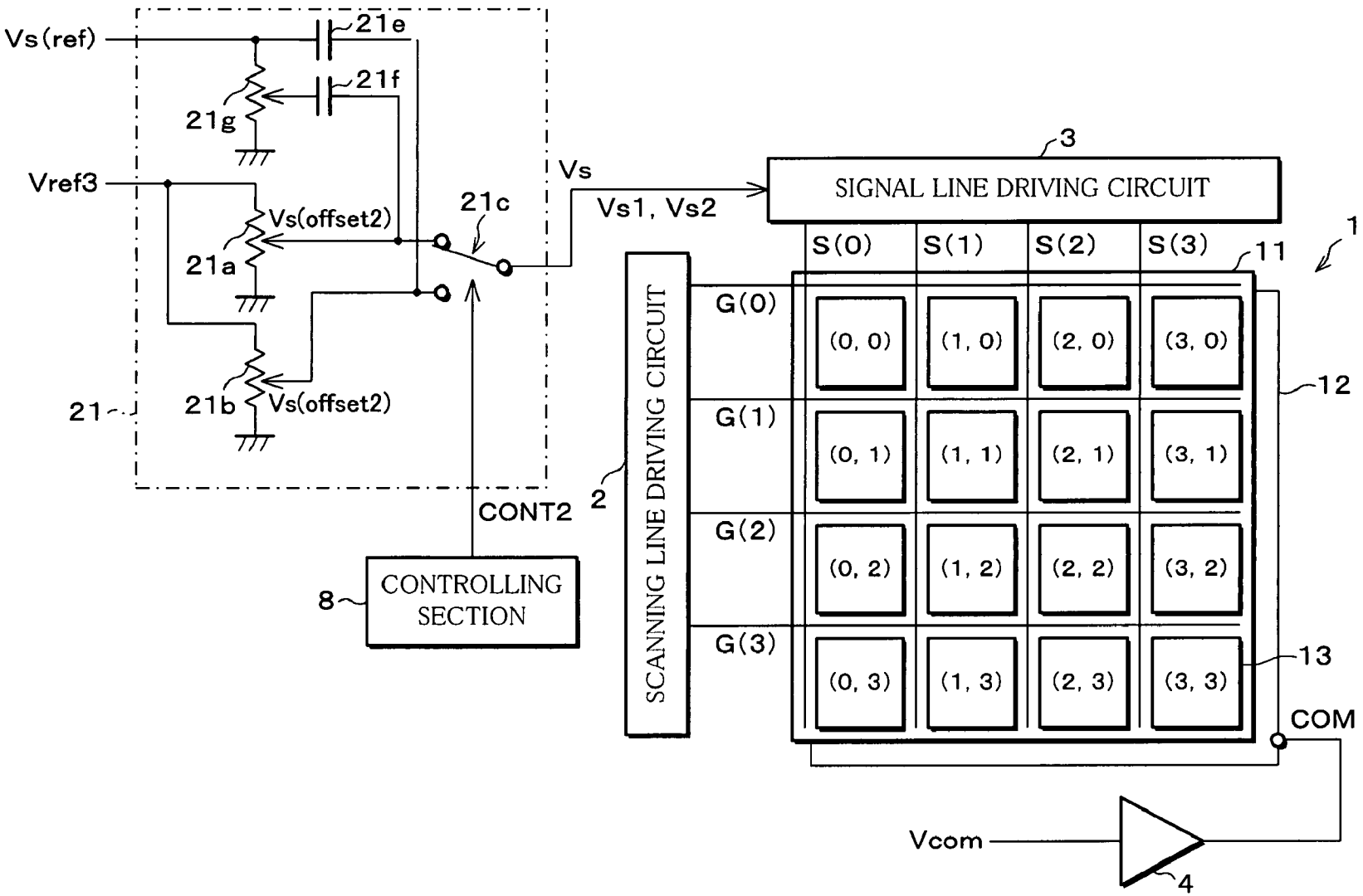
FIG. 12 is a block diagram showing a structure of the liquid crystal display device according to a modification example of the fourth embodiment of the present invention.

In order to realize the source signals Vs1 and Vs2 which are different in amplitude, as shown in FIG. 12, the offset voltage setting section 21 includes AC coupling capacitors 21*e* and 21*f* instead of the coupling capacitor 21*d*, and a resistance 21*g* (variable resistance) as amplitude varying means. In the AC coupling capacitor 21*e*, the pulse signal Vs(ref) is inputted to one end, and the other end is connected to an input terminal on the side of the resistance 21*b* in the switch 21*c*. In the AC coupling capacitor 21*f*, the pulse signal Vs(ref) is inputted via the resistance 21*g* to one end, and the other end is connected to an input terminal on the side of the resistance 21*a* in the switch 21*c*.

In the offset voltage setting section 21, amplitude of the pulse signal Vs(ref) is reduced by the resistance 21, so that the source signal Vs1 having small amplitude is obtained. While, the source signal Vs2 whose amplitude is larger than that of the source signal Vs1 is obtained from the AC coupling capacitor 21*e*. When the source signals Vs1 and Vs2 which are different in amplitude are used, a voltage including compensation of a leak discharge is applied in the refresh period Tv2 as in the liquid crystal display device of the third embodiment. As a result, it is possible to equalize all the effective voltages Vrms(N1), Vrms(N7), Vrms(P1), and Vrms(P7).

[Fifth Embodiment]

The fifth embodiment of the present invention is described as follows based on FIG. 13 and FIG. 14. Note that, in the present embodiment, components having the same function as the components in the first embodiment are given the same reference numerals, and descriptions thereof are omitted.

Figure 13:
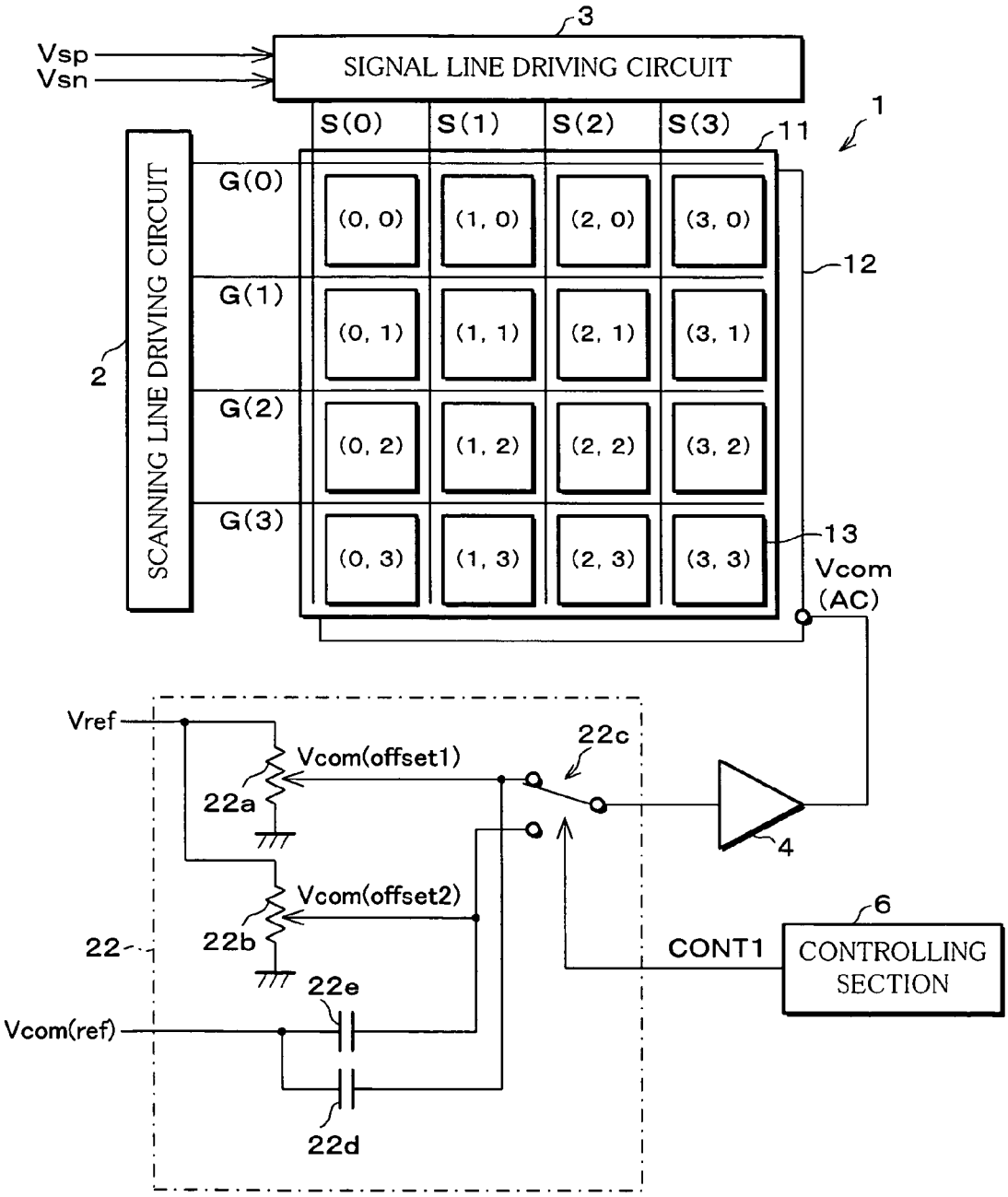
FIG. 13 is a block diagram showing a structure of the liquid crystal display device according to the fifth embodiment of the present invention.

A liquid crystal display device according to the present embodiment, as shown in FIG. 13, includes a liquid crystal panel 1, a scanning line driving circuit 2, a signal line driving circuit 3, a buffer circuit 4, and a controlling section 6, as in the liquid crystal display device of the first embodiment. Further, the present liquid crystal display device includes an offset voltage setting section 22 instead of the offset voltage setting section 5 of the first embodiment (see FIG. 1). The present liquid crystal display device, unlike the liquid crystal display device of the first embodiment, as shown in FIG. 14, uses a common signal Vcom(AC) which is reversed in every horizontal line, and offsets a mean potential of an amplitude of the common signal Vcom(AC), that is, the level of the common signal Vcom(AC). The common signal Vcom(AC) includes amplitude of the difference between the highest value and the lowest value, and is supplied from the known circuit which is provided outside of the offset voltage setting section 22 and generates a common signal (pulse signal Vcom(ref) described later) which is reversed.

As shown in FIG. 13, the offset voltage setting section 22 includes resistances 22*a* and 22*b*, a switch 22*c*, and an AC coupling capacitors 22*d* and 22*e*. In each resistance 22*a* to 22*b* as voltage setting means, a certain standard potential V ref is inputted to one end, and the other end is grounded. Further, resistances 22*a* to 22*b* are variable resistances, so that it is possible to adjust the offset, and a mean potential of an amplitude Vcom(offset1) on the side of a low potential and a mean potential of an amplitude Vcom(offset2) on the side of a high potential are supplied from taps of respective resistances.

The mean potential of an amplitude Vcom(offset1) is inputted to one connecting point of the switch 22*c*, and the mean potential of an amplitude Vcom(offset2) is inputted to the other connecting point 22*c*. The switch 22*c* switches any one of the mean potential of an amplitude Vcom(offset1) and the mean potential of an amplitude Vcom(offset2) and outputs the switched amplitude potential to the counter electrode 16 (see FIG. 20) by the controlling signal CONT1 transmitted from the controlling section 6. Further, in each AC coupling capacitor 22*d* and 22*e*, the pulse signal Vcom (ref) which is reversed in every horizontal line is inputted to one end. And the other end of the AC capacitor 22*d* is connected to an input terminal on the side of the resistance 22*a* in the switch 22*c*, and the other end of the AC capacitor 22*e* is connected to an input terminal on the side of the resistance 22*b* in the switch 22*c*.

According to the liquid crystal display device arranged in the foregoing manner, in the offset voltage setting section 22, a switching operation of the switch 22*c* allows any one of the mean potential of an amplitude Vcom(offset1) and the mean potential of an amplitude Vcom(offset2) to be outputted. Then, the pulse signal Vcom(ref) whose DC component was removed by the coupling capacitors 22*d* and 22*e* is superposed on the outputted mean potential of an amplitude. Thus, the first and second signals Vcom1 and Vcom2 which are different in the refresh periods Tv1 and Tv2 respectively are given to the counter electrode 16.

First, in the offset voltage setting section 22, the first signal Vcom1 is selected as the common signal Vcom (AC), and is given to the counter electrode 16 in the display mode A. Then, as shown in FIG. 14, in the first refresh period Tv1, the differential voltage (value in a circle) between a voltage of the source signal Vs which is applied in a period of the gate pulse and the common signal Vcom(AC) is applied and is stored as a driving voltage. While, in the next refresh period Tv1, the differential voltage and a differential voltage of a reversed polarity is applied and stored in the period of the gate pulse. Here, the effective voltage Vrms(P1) of a liquid crystal driving voltage V clc in the first refresh period Tv1 is almost equal to the effective voltage Vrms(N1) of the liquid crystal driving voltage Vclc in the next refresh period Tv1 by setting a value of the first signal Vcom1.

Figure 14:
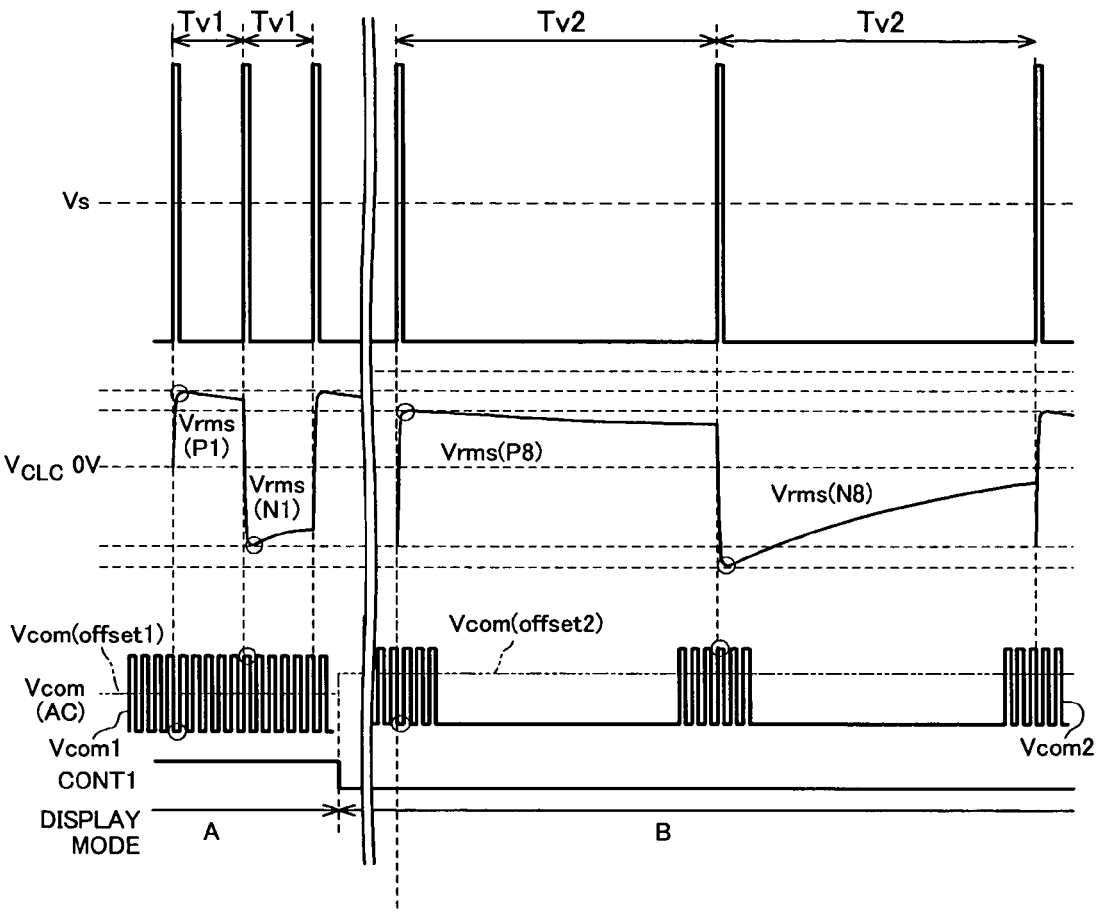
FIG. 14 is a wave-form figure showing a driving operation of the liquid crystal display device of FIG. 13.

Note that, although the source signal Vs is drawn as d.c. to simplify the drawing in FIG. 14, the source signal Vs may be a pulse signal which is in- or off-phase with the common signal Vcom(AC). When the source signal Vs is DC of 2V, and the common signal Vcom(AC) has the lowest value of 0V and the highest value of 4V, the liquid crystal driving voltage reverses the polarity in voltage range of ±2V.

While, in the offset voltage setting section 22, the second signal Vcom2 is selected as the common signal Vcom(AC) in the display mode B. Then, as in the display mode A, the differential voltage (value in a circle) is applied and stored. Thus, as in the liquid crystal display device of the first embodiment, the effective voltage Vrms(P8) becomes almost equal to the effective voltage Vrms(N8).

In this way, in the liquid crystal display device of the present embodiment, the mean potential of an amplitude (level of the common voltage) of the common signal Vcom (AC) which is reversed in every horizontal line is offset, so that it is possible to improve the quality of a displayed image as in the liquid crystal display device of the first embodiment.

[Sixth Embodiment]

The sixth embodiment of the present invention is described as follows based on FIG. 15 and FIG. 16. Note that, in the present embodiment, components having the same function as the components in the fifth embodiment are given the same reference numerals, and descriptions thereof are omitted.

Figure 15:
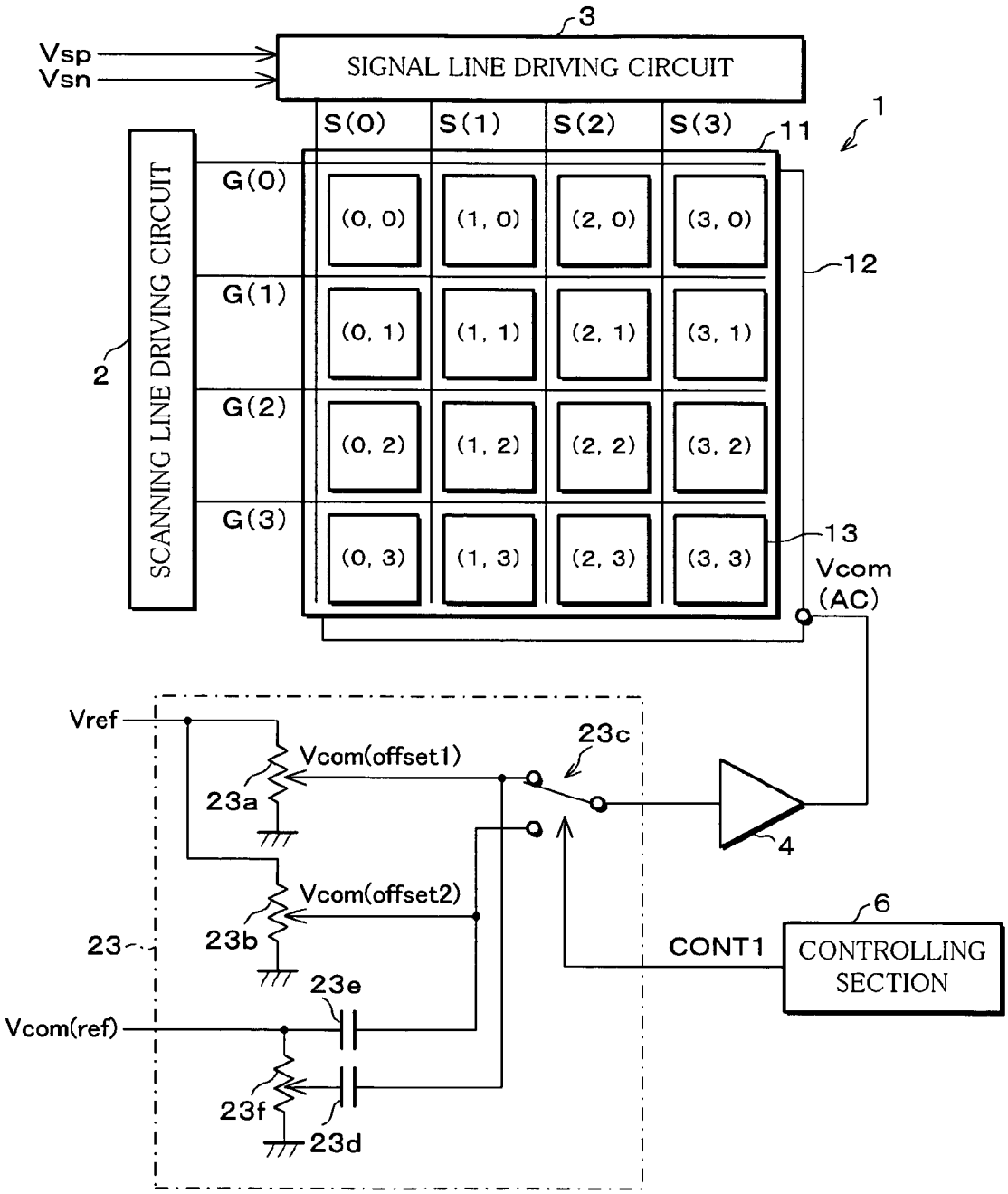
FIG. 15 is a block diagram showing a structure of the liquid crystal display device according to the sixth embodiment of the present invention.

A liquid crystal display device according to the present embodiment, as shown in FIG. 15, includes a liquid crystal panel 1, a scanning line driving circuit 2, a signal line driving circuit 3, a buffer circuit 4, and a controlling section 6, as in the liquid crystal display device of the fifth embodiment. Further, the present liquid crystal display device includes an offset voltage setting section 23 instead of the offset voltage setting section 22 of the fifth embodiment (see FIG. 13). The present liquid crystal display device, as in the liquid crystal display device of the fifth embodiment, offsets a mean potential of an amplitude of the common signal Vcom(AC) in the refresh periods Tv1 and Tv2, and further, varies the amplitude.

The offset voltage setting section 23 includes resistances 22*a* and 22*b*, resistances 23*a* and 23*b* which have the same functions as the functions of a switch 22*c* and the AC coupling capacitors 22*d* and 22*e*, a switch 23*c* and AC coupling capacitors 23*d* and 23*e*, and further includes a resistance 23*f* as amplitude varying means. In the offset voltage setting section 23, unlike the offset voltage setting section 22, a pulse signal Vcom(ref) is inputted via the resistance 23*f* which is a variable resistance to the AC coupling capacitor 23*d*.

In the offset voltage setting section 23, amplitude of the pulse signal Vcom(ref) is reduced by the resistance 23*f*, so that the first common voltage Vcom1 having the reduced amplitude AC1 is obtained. While, the second common voltage Vcom2 having amplitude AC2 which is larger than the amplitude AC1 is obtained from the AC coupling capacitor 23*e*. Thus, not only the central potential, but also the first and second common voltages Vcom1 and Vcom2 which are different also in the amplitude are obtained. Further, the common voltages Vcom1 and Vcom2 are given to the counter electrode 16 in the refresh periods Tv1 and Tv2.

First, in the offset voltage setting section 23, the first common voltage Vcom1 is selected as the common signal Vcom (AC), and is given to the counter electrode 16 in the display mode A. Then, as shown in FIG. 16, in the first refresh period Tv1, the differential voltage (value in a circle) between a voltage of the source signal Vs which was fetched in a period of the gate pulse and the first common voltage Vcom1 is applied and is stored. While, in the next refresh period Tv1, the differential voltage and a differential voltage of a reversed polarity is applied and stored in the period of the gate pulse. Here, the effective voltage Vrms(P1) of a liquid crystal driving voltage V clc in the first refresh period Tv1 is almost equal to the effective voltage Vrms(N1) of the liquid crystal driving voltage V clc in the next refresh period Tv1 by setting a value of the first common voltage Vcom1.

While, in the offset voltage setting section 23, the second common voltage Vcom2 is selected as the common signal Vcom(AC) in the display mode B. Then, as in the display mode A, the differential voltage (value in a circle) is applied and stored. Thus, as in the liquid crystal display device of the first embodiment, the effective voltage Vrms(P9) becomes almost equal to the effective voltage Vrms(N9). Moreover, amplitude of the common signal Vcom(AC) is large in the refresh period Tv2, so that amplitude of the liquid crystal driving voltage V clc becomes large. Therefore, as in the liquid crystal display device of the third embodiment, the refresh period Tv2 becomes long, so that it is possible to prevent the drop of the stored voltage which occurs due to a leak discharge when the TFT is OFF. Thus, it is possible to equalize all the effective voltages Vrms(N1) Vrms(N9), Vrms(P1), and Vrms(P9).

Also in the liquid crystal display device of the present embodiment, the common signal Vcom(AC) which is reversed in every horizontal line is offset, so that it is possible to improve the quality of a displayed image as in the liquid crystal display device of the fifth embodiment.

Figure 16:
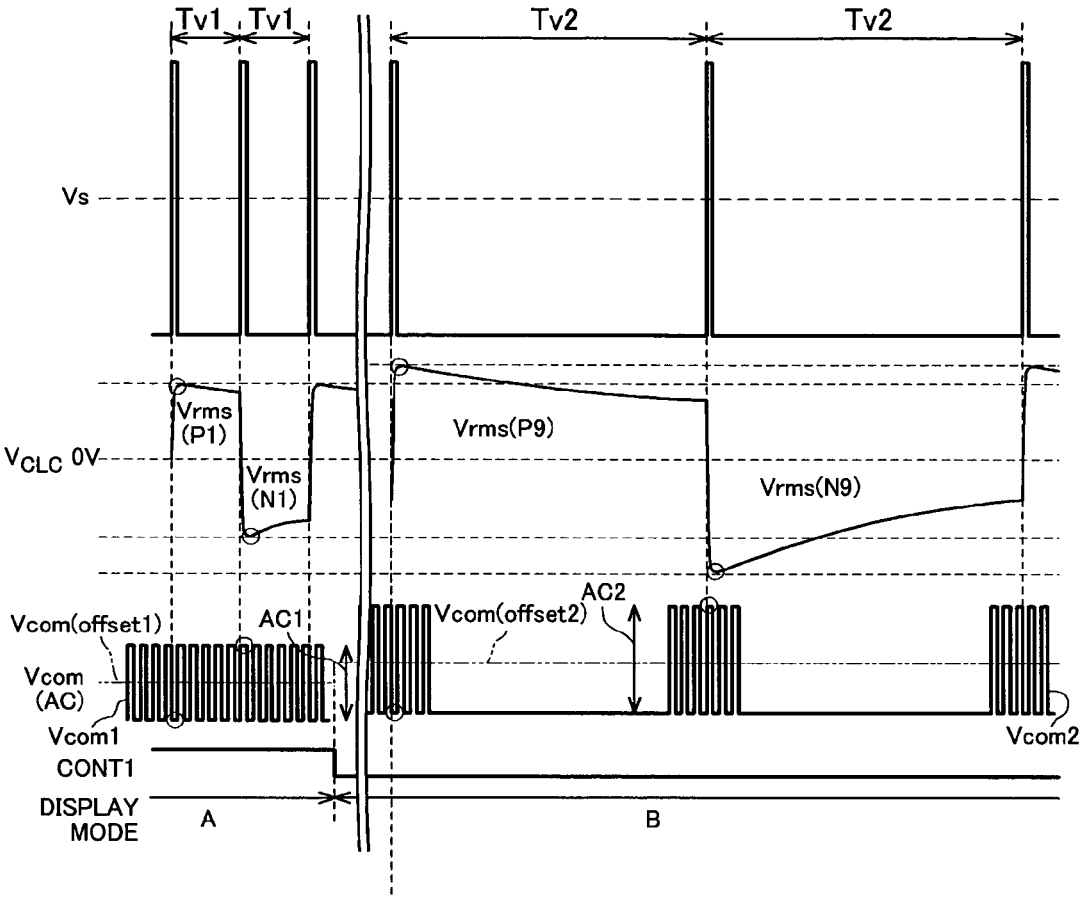
FIG. 16 is a wave-form figure showing a driving operation of the liquid crystal display device of FIG. 15.

Note that, although the source signal Vs is drawn as d.c. to simplify the drawing in FIG. 16, the source signal Vs may be a pulse signal which is in- or off-phase with the common signal Vcom(AC). In the display mode A, when the source signal Vs is DC of 2V, and the common signal Vcom(AC) is AC of 4V, the liquid crystal driving voltage V clc reverses the polarity in voltage range of ±2V. Further, in the display mode B, the source signal Vs is DC of 2V as in the display mode A. However, when amplitude of the common signal Vcom(AC) (difference between H level and L level) is equally AC of 5V, the liquid crystal driving voltage V clc reverses the polarity in voltage range of ±2.5V. In this case, the effective voltages Vrms(N1), Vrms(N9), Vrms(P1), and Vrms(P9) become equal.

Note that, although, in the present embodiment and other embodiments described above, a.c. driving methods of a field or frame reversal and a line reversal are described, the present invention can be applied to other known reversal driving methods such as a dot reversal and a source reversal.

Further, although, in the present embodiment and other embodiments described above, driving methods of a liquid crystal display device and the liquid crystal display device which uses the driving methods are described, the present invention can be applied to a liquid crystal display device with an auxiliary capacitance which is arranged so that a liquid crystal capacitance and the auxiliary capacitance are provided in parallel, and to a liquid crystal display device of IPS mode which is arranged so that a counter electrode is provided on the matrix substrate on which a TFT is provided. Further, a display device is not restricted to an active matrix liquid crystal display device, but may be an EL (Electro Luminescence) display device. Further, the foregoing display device can be provided in a cellular phone, a pocket game machine, a PDA (Personal Digital Assistants), a portable TV, a remote control, a note type personal computer, and other portable terminals. These portable terminals are driven almost by a battery. Thus, it is possible to drive the portable terminals in a long time by including the display device which can reduce power consumption with the quality of display kept good.

Further, in the present embodiment and other embodiments described above, after a scanning period in which applying is performed in the display cells 13 of one screen, a state of a voltage in the respective display cells 13 may be kept in a non-scanning period which is longer than the scanning period. By this, a scanning is not performed in the non-scanning period, so that it is possible to cease driving-related circuits. Therefore, it is possible to reduce power consumption. Further, when a period in which the display cell 13 maintains a voltage is long, an imbalance of the stored voltage occurs between positive and negative polarities due to a leak characteristic of the TFT etc. In order solve the problem, levels (in a case of a.c., mean potential of an amplitude) of the common voltage Vcom and the common voltage Vcom(AC) or the signal voltages Vsp and Vsn and the sours signal Vs are varied as described above, so that it is possible to avoid the occurrence of such an imbalance.

[Structure of the Liquid Crystal Display Device]

Here, the following is a structure example of a common liquid crystal display device in the respective embodiments described above. The description is based on FIG. 17 and FIG. 18. Here, a reflecting liquid crystal display device which includes an auxiliary capacitance provided in parallel with a liquid crystal capacitance is described as an example.

Figure 17:
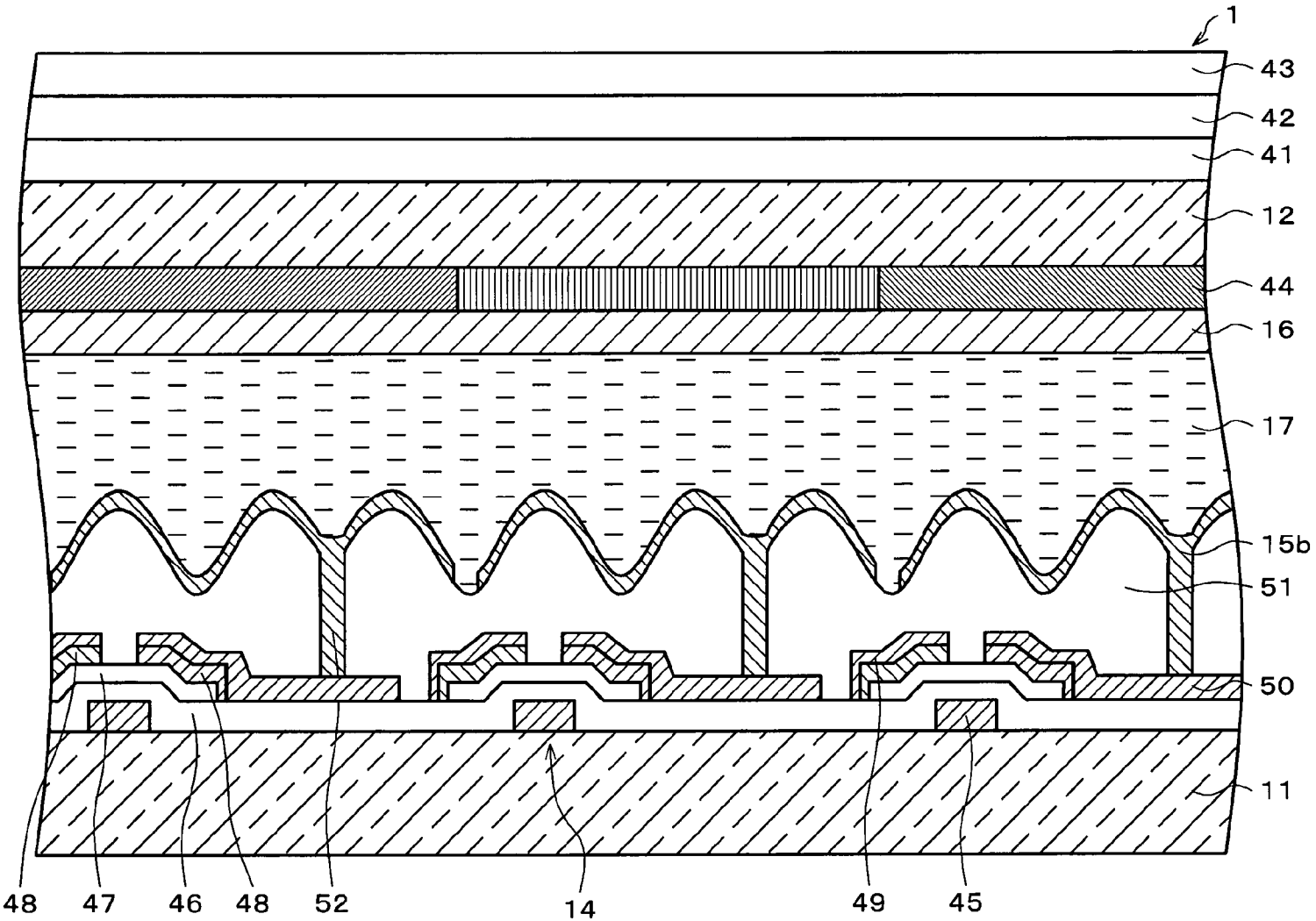
FIG. 17 is a cross sectional view showing a structure of the liquid crystal display device according to the first to sixth embodiments of the present invention.

FIG. 17 is a cross sectional view of a structure of a liquid crystal panel 1. The cross sectional view of FIG. 17 is a view which is seen from a sectional line C—C of FIG. 18. The liquid crystal panel 1 is a reflecting active matrix type liquid crystal display device, and has a basic structure in which a liquid crystal 17 such as a nematic liquid crystal is provided between the matrix substrate 11 and the facing substrate 12, and the TFTs 14 are formed on the matrix substrate 11 as an active element. Note that, although the TFT is used as an active element in the present embodiment, an MIM (Metal Insulator Metal) or an active element other than the TFT can be used. A phase difference plate 41, a polarizing plate 42, and an antireflection film 43 are provided on a top face of the facing substrate 12 in this order so as to control a state of incident light. A color filter 44 of RGB, and the transparent counter electrode 16 are provided in this order on the underside of the facing substrate 12. Due to the color filter 44, color display is possible.

Figure 18:
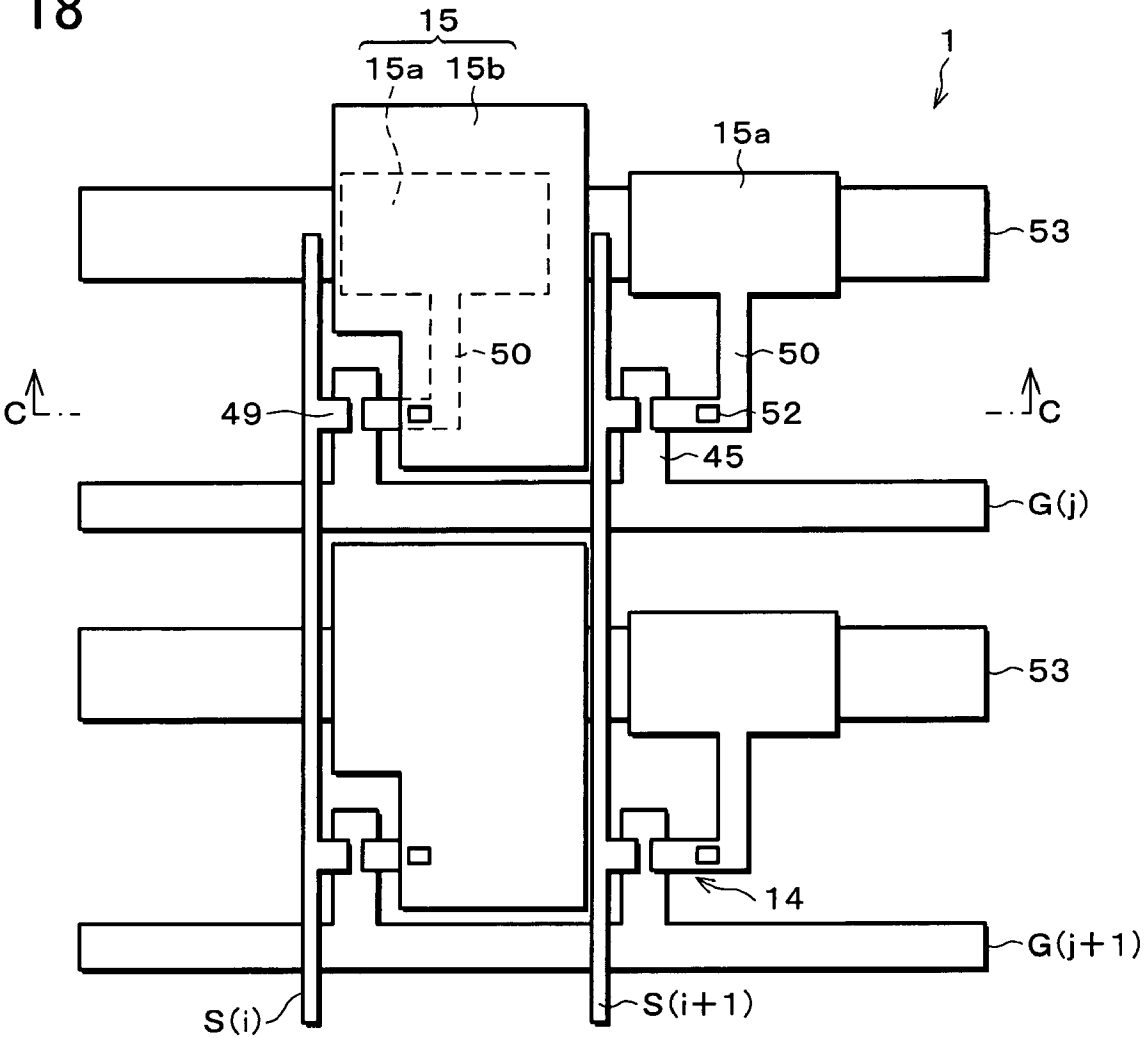
FIG. 18 is a plan view showing a structure of the liquid crystal display device of FIG. 17.
Figure 19:
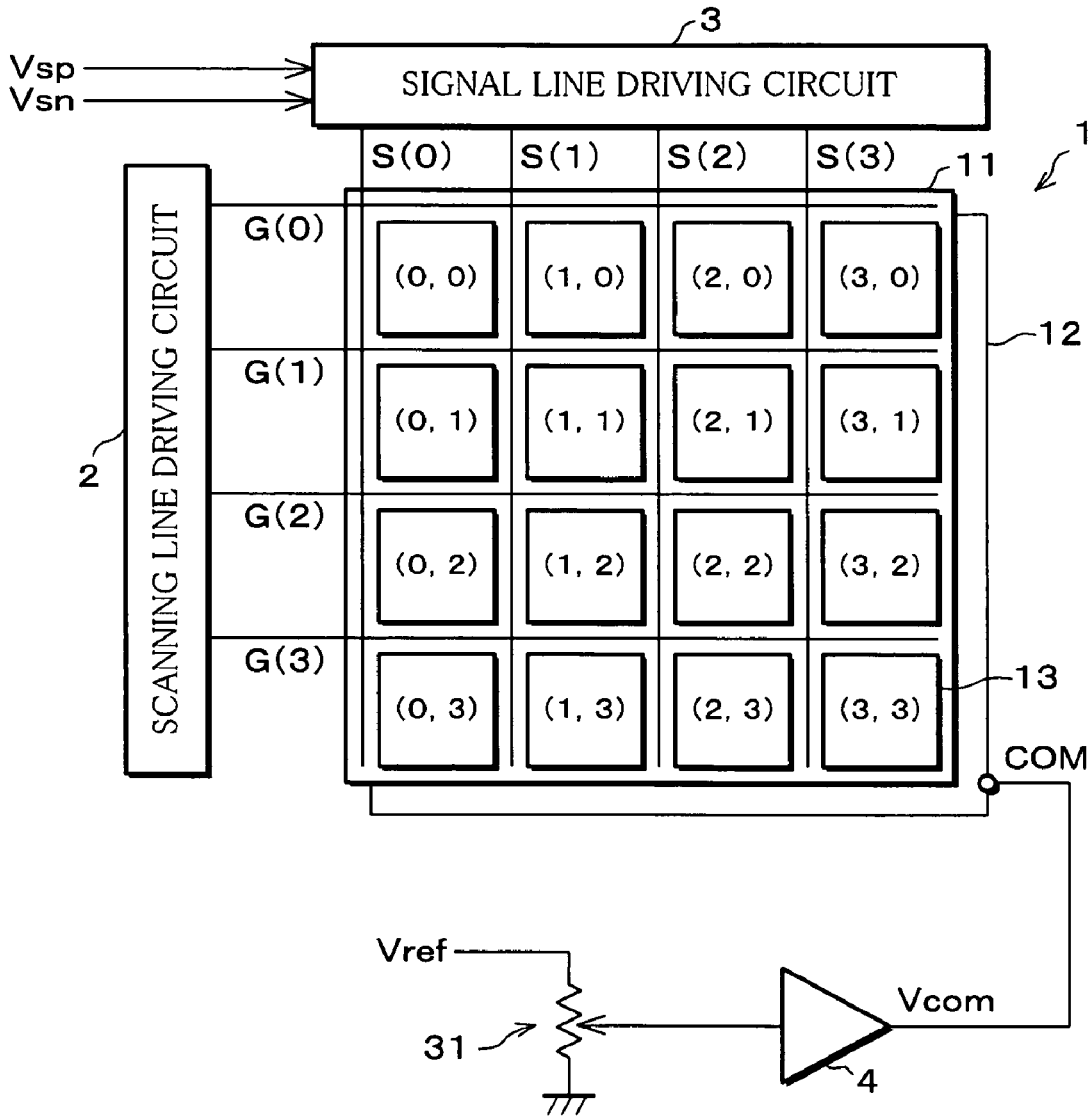
FIG. 19 PRIOR ART
FIG. 19 is a block diagram showing a structure of a conventional liquid crystal display device.

In each TFT 14, a portion of the scanning line which is provided on the matrix substrate 11 functions as a gate electrode 45, and a gate insulating film 46 is formed on the gate electrode 45. An i type amolphous silicon layer 47 is formed so that it faces the gate electrode 45 with the gate insulating film 46 provided therebetween, and two $n^+$ type amolphous silicon layers 48 are formed so that the two $n^+$ type amolphous silicon layers 48 faces each other with a channel area of the i type amolphous silicon layer 47 being therebetween. A data electrode 49 which is a portion of a signal line is formed on the top face of one $n^+$ type amolphous silicon layer 48, and a drain electrode 50 is formed so that it is taken from the top face of the other $n^+$ type amolphous silicon layer 48 to the top face of a flat portion of the gate insulating film 46. A portion where the drain electrode 50 is taken to an upper side of the gate insulating film 46, as shown in FIG. 18, is connected to a rectangular auxiliary capacitance electrode pad 15*a* which faces a auxiliary capacitance wiring 53. A layer insulating film 51 is formed on the top face of the TFTs 14, and reflecting electrodes 15*b* are provided on the top face of the layer insulating film 51. The reflecting electrodes 15*b* are reflecting members for performing reflecting display by using surrounding light. Minute irregularities are formed on a surface of the layer insulating film 51 so as to control a direction of reflected light of the reflecting electrodes 15*b*.

Further, respective reflecting electrodes 15*b* are conducted via contact holes 52 provided on the layer insulating film 51 to the drain electrode 50. That is, a voltage which is applied by the data electrode 49 and is controlled by the TFT 14 is applied from the drain electrode 50 via the contact hole 52 to the display electrode 15, and the liquid crystal 17 is driven by a voltage between the reflecting electrode 15*b* and the counter electrode 16. The auxiliary capacitance electrode pad 15*a* and the reflecting electrode 15*b* are conducted to each other, the liquid crystal 17 exists between the reflecting electrode 15*b* and the counter electrode 16. In this way, the auxiliary capacitance electrode pad 15*a* and the reflecting electrode 15*b* make up the display electrode 15. In a case of a transmitting liquid crystal display device, transparent electrodes which are provided so that they correspond to the foregoing electrodes are used as picture elements electrodes.

Further, in the liquid crystal panel 2, as shown in FIG. 18 which is a top view of a lower portion with respect to the liquid crystal 17 of FIG. 17, scanning lines G(j) which supply a scanning signal to the gate 45 of the TFT 14 and signal lines S(i) which supply a data signal to the data electrode 49 of the TFT 14 are provided so that they cross at right angle on the matrix substrate 11. Further, auxiliary capacitance wirings 53 are provided as auxiliary capacitance electrodes which form auxiliary capacities of picture elements between respective auxiliary capacitance electrode pads 15*a*. The auxiliary capacitance wirings 53 are provided in parallel with the scanning lines G(j) on the matrix substrate 11 so that the auxiliary capacitance wiring 53 faces the auxiliary capacitance electrode pad 15*a* with the gate insulating film 46 provided therebetween. As long as the auxiliary capacitance wirings 53 are provided away from the scanning lines G(j), the auxiliary capacitance may be arranged in other manners. Note that, a portion of the reflecting electrodes 15*b* is omitted so as to clarify the positioning relation between the auxiliary capacitance electrode pads 15*a* and the auxiliary capacitance wirings 53 in FIG. 18. Further, the irregularities formed on the surface of the layer insulating film 51 of FIG. 17 are not shown in FIG. 18.

In the reflecting active matrix type liquid crystal display device as described above, back light which consumes extremely much power is not required. Thus, even when a high-speed refresh display mode which can realizes an animation display and a low-speed refresh mode which is to save power are switched as required in the reflecting active matrix type liquid crystal display device used suitably in portable data terminals including a cellular phone, so that it is possible to largely reduce the flicker which is likely to occur in the liquid crystal display device.

Further, the active matrix type display device and its driving method of the present invention may be arranged so that voltage switching means corresponding to an applying-storing period is provided, and voltage setting means for setting d.c. voltage is provided, and a current flows in only the selected voltage setting means. Arranged in this way, a current does not flow in the voltage setting means which is not selected. Thus, power is not consumed by resistance of the voltage setting means.

Further, in the display device and the driving method, a.c. voltage is used as the common voltage or the signal voltage, and a mean potential of an amplitude of the a.c. voltage may be varied as the level in every applying-storing period of a different length. When the common voltage or the signal voltage is a.c. in this way, an effective value of a driving voltage is changed also by varying the mean potential of an amplitude (level). Alternatively, a.c. voltage may be used as the common voltage, and amplitude of the a.c. voltage may be varied by the amplitude varying means in every applying-storing period of a different length. In this way, the effective value of the driving voltage is changed also by varying amplitude of the common voltage of a.c., and amplitude is set to be comparatively large when the applying-storing period is long, so that it is possible to compensate a drop of the stored driving voltage. The drop of the stored driving voltage is brought about by a leak of a charge from the storage capacitor due to an operation characteristic of the active element. Thus, it is possible to obtain an effect that the quality of a displayed image can be improved.

When the signal voltage is varied, the level may be varied with respect to only one of the polarities of the signal voltage which are reversed to the other polarity in every adjacent applying-storing period, and the level may be varied with respect to the both polarities of the signal voltage.

In the driving method, after the scanning period in which the signal voltage is applied to the display electrode of one screen, it is preferable that a non-scanning period, longer than the scanning period, in which the signal voltage is not applied. By this, the scanning is not performed in the non-scanning period, so that it is possible to cease a driving-related circuit. Therefore, it is possible to reduce power consumption. Further, when a period in which the storage capacitor maintains a voltage is long, an imbalance of the stored voltage occurs between positive and negative polarities due to a leak characteristic of the TFT etc. In order solve the problem, the common voltage or the level of the signal voltage is varied, so that it is possible to avoid the occurrence of such an imbalance.

In the driving method, it is preferable that the active matrix type display device is a reflecting active matrix type liquid crystal display device including a reflecting electrode in the display electrode. Thus, even when a high-speed refresh display mode which can realizes an animation display and a low-speed refresh mode which is to save power are switched as required in the reflecting active matrix type liquid crystal display device used suitably in portable data terminals including a cellular phone, it is possible to largely reduce the flicker which is likely to occur in the liquid crystal display device.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A driving method of an active matrix display device which includes plural display electrodes provided in a matrix manner, a counter electrode which is provided so that the counter electrode faces the display electrodes and a common voltage is applied to the counter electrode, an active element for applying a signal voltage to the display electrodes when a scanning line is selected, a storage capacitor for storing a driving voltage which is determined by the signal voltage applied to the display electrodes and the common voltage applied to the counter electrode, wherein a level of the common voltage is varied according to a length of an applying-storing period for applying the signal voltage and storing the driving voltage, such that a lower common voltage is applied during a shorter applying-storing period, and a higher common voltage is applied during a longer applying-storing period.

2. The driving method of the active matrix display device set forth in claim 1, wherein plural d.c. voltages are used as the common voltage so as to switch the d.c. voltages in every applying-storing period of a different length.

3. The driving method of the active matrix display device set forth in claim 1, wherein an a.c. voltage is used as the common voltage so as to vary a level of a mean potential of an amplitude of the a.c. voltage in every applying-storing period of a different length.

4. The driving method of the active matrix display device set forth in claim 1, wherein an a.c. voltage is used as the common voltage so as to vary an amplitude of the a.c. voltage in every applying-storing period of a different length.

5. The driving method of the active matrix display device set forth in claim 1, wherein after a scanning period in which the signal voltage is applied to the display electrodes of one screen, a non-scanning period, longer than the scanning period, in which the signal voltage is not applied is provided.

6. The driving method of the active matrix display device set forth in claim 1, wherein said active matrix type display device is a reflecting active matrix type display device including reflecting electrodes in the display electrodes.

7. A driving method of an active matrix display device which includes plural display electrodes provided in a matrix manner, a counter electrode which is provided so that the counter electrode faces the display electrodes and a common voltage is applied to the counter electrode, an active element for applying a signal voltage to the display electrodes when a scanning line is selected, a storage capacitor for storing a driving voltage which is determined by the signal voltage applied to the display electrodes and the common voltage applied to the counter electrode, wherein a level of the signal voltage is varied according to a length of an applying-storing period for applying the signal voltage and storing the driving voltage, such that a lower common voltage is applied during a shorter applying-storing period, and a higher common voltage is applied during a longer applying-storing period.

8. The driving method of the active matrix display device set forth in claim 7, wherein plural d.c. voltages are used as the signal voltage so as to switch the d.c. voltages in every applying-storing period of a different length.

9. The driving method of the active matrix display device set forth in claim 7, wherein a level of a signal voltage is varied with respect to only one of the polarities of the signal voltage which are reversed in every adjacent applying-storing period.

10. The driving method of the active matrix display device set forth in claim 7, wherein a level of the signal voltage is varied with respect to both polarities of the signal voltage which are reversed in every adjacent applying-storing period.

11. The driving method of the active matrix display device set forth in claim 7, wherein an a.c. voltage is used as the signal voltage so as to vary a level of a mean potential of an amplitude of the a.c. voltage in every applying-storing period of a different length.

12. The driving method of the active matrix display device set forth in claim 7, wherein an a.c. voltage is used as the signal voltage so as to vary an amplitude of the a.c. voltage in every applying-storing period of a different length.

13. The driving method of the active matrix display device set forth in claim 7, wherein after a scanning period in which the signal voltage is applied to the display electrodes of one screen, a non-scanning period, longer than the scanning period, in which the signal voltage is not applied is provided.

14. The driving method of the active matrix display device set forth in claim 7, wherein said active matrix type display device is a reflecting active matrix type display device including reflecting electrodes in the display electrodes.

15. An active matrix display device comprising:

plural display electrodes provided in a matrix manner;

a counter electrode which is provided so that the counter electrode faces the display electrodes and a common voltage is applied to the counter electrode;

an active element for applying a signal voltage to the display electrodes when a scanning line is selected;

a storage capacitor for storing a driving voltage which is determined by the signal voltage applied to the display electrodes and the common voltage applied to the counter electrode; and level varying means for varying a level of the common voltage according to a length of an applying-storing period in which the signal voltage is applied and the driving voltage is stored, such that a lower common voltage is applied during a shorter applying-storing period, and a higher common voltage is applied during a longer applying-storing period.

16. The active matrix display device set forth in claim 15, wherein said level varying means includes voltage switching means by which plural d.c. voltages as the common voltage are switched in every applying-storing period of a different length.

17. The active matrix display device set forth in claim 16, wherein said voltage switching means is provided so as to correspond itself to the applying-storing period, and includes voltage setting means for setting the d.c. voltages, and applies a current only to a selected voltage setting means.

18. The active matrix display device set forth in claim 15, wherein said level varying means varies a level of a mean potential of an amplitude of an a.c. voltage as the common voltage in every applying-storing period of a different length.

19. The active matrix display device set forth in claim 15, wherein said level varying means includes amplitude varying means which varies an amplitude of an a.c. voltage as the common voltage in every applying-storing period of a different length.

20. An active matrix display device comprising:

plural display electrodes provided in a matrix manner;

a counter electrode which is provided so that the counter electrode faces the display electrodes and a common voltage is applied to the counter electrode;

an active element for applying a signal voltage to the display electrodes when a scanning line is selected;

a storage capacitor for storing a driving voltage which is determined by the signal voltage applied to the display electrodes and the common voltage applied to the counter electrode; and level varying means for varying a level of the signal voltage according to a length of an applying-storing period in which the signal voltage is applied and the driving voltage is stored, such that a lower common voltage is applied during a shorter applying-storing period, and a higher common voltage is applied during a longer applying-storing period.

21. The active matrix display device set forth in claim 20, wherein said level varying means includes voltage varying means by which plural d.c. voltages as the signal voltage are switched in every applying-storing period of a different length.

22. The active matrix display device set forth in claim 21, wherein said voltage switching means is provided so as to correspond itself to the applying-storing period, and includes voltage setting means for setting the d.c. voltages, and applies a current only to a selected voltage setting means.

23. The active matrix display device set forth in claim 20, wherein said level varying means varies a level of the signal voltage with respect to only one of the polarities of the signal voltage which are reversed in every adjacent applying-storing period.

24. The active matrix display device set forth in claim 20, wherein said level varying means varies a level of the signal voltage with respect to both polarities of the signal voltage which are reversed in every adjacent applying-storing period.

25. The active matrix display device set forth in claim 20, wherein said level varying means varies a level of a mean potential of an amplitude of an a.c. voltage as the signal voltage in every applying-storing period of a different length.

26. The active matrix display device set forth in claim 20, wherein said level varying means includes amplitude varying means which varies an amplitude of an a.c. voltage as the signal voltage in every applying-storing period of a different length.

* * * * *